US005249611A

United States Patent [19]

Law

[11] Patent Number: 5,249,611

[45] **Date of Patent: * Oct. 5, 1993**

[54] POUR SPOUT

[75] Inventor: Verl Law, Emmett, Id.

[73] Assignee: Vemco, Inc., Emett, Id.

[ * ] Notice: The portion of the term of this patent subsequent to May 30, 2006 has been disclaimed.

[21] Appl. No.: 704,429

[22] Filed: May 23, 1991

Related U.S. Application Data

[63] Continuation-in-part of Ser. No. 361,590, May 30, 1989, Pat. No. 5,076,333, which is a continuation-in-part of Ser. No. 27,014, Mar. 16, 1987, Pat. No. 4,834,151.

[51] Int. Cl.[5] ..... B65C 3/00; B65B 39/04

[52] U.S. Cl. ..... 141/198; 141/39; 141/291; 141/296; 141/302; 141/352; 141/335

[58] Field of Search ..... 141/192, 198, 193, 291-302, 141/305-307, 309, 351-354, 335, 344, 345, 39

[56] References Cited

U.S. PATENT DOCUMENTS

| | | | |
|---|---|---|---|
| 245,401 | 8/1881 | Raynor et al. | 141/357 |
| 525,744 | 9/1894 | Roth | 141/353 |
| 1,345,965 | 7/1920 | Shute . | |
| 1,820,197 | 8/1931 | McGhee et al. | 141/129 X |
| 2,154,583 | 4/1939 | Rodgers | 141/292 |
| 2,341,950 | 2/1944 | Schepps | 141/387 |
| 2,445,130 | 7/1948 | Turner | 222/482 |
| 2,593,634 | 4/1952 | Vosburg | 222/514 |
| 2,681,759 | 6/1954 | Risser | 141/293 |
| 2,701,078 | 2/1955 | Bowman | 222/117 |
| 2,743,047 | 4/1956 | Clarke | 141/193 |
| 3,005,475 | 10/1961 | Beall, Jr. | 141/198 |
| 3,207,190 | 9/1965 | Silbereis et al. | 141/198 |
| 3,263,711 | 8/1966 | Laub | 141/40 |
| 3,289,712 | 12/1966 | Smith | 141/295 |
| 3,540,402 | 11/1970 | Kocher | 141/198 |
| 3,595,281 | 7/1971 | Laub. | 141/46 |
| 3,994,323 | 11/1976 | Takahata et al. | 141/302 |
| 4,314,657 | 2/0982 | Perakis et al. | 222/162 |
| 4,588,111 | 5/1386 | Hestehave | 222/479 |
| 4,598,743 | 7/1986 | Milling | 141/296 |
| 4,667,710 | 5/1987 | Wu | 141/198 |
| 4,834,151 | 5/1989 | Law | 141/198 |
| 5,076,333 | 12/1991 | Law | 141/198 |

FOREIGN PATENT DOCUMENTS

| | | | |
|---|---|---|---|
| 11818 | 3/1976 | Australia . | |
| 3602101 | 7/1987 | Fed. Rep. of Germany . | |
| 1179560 | 5/1959 | France | 141/335 |
| 2303730 | 3/1976 | France . | |
| 368214 | 3/1932 | United Kingdom | 141/335 |
| 1569872 | 6/1980 | United Kingdom | 141/335 |

*Primary Examiner*—Ernest G. Cusick
*Attorney, Agent, or Firm*—Workman, Nydegger & Jensen

[57] ABSTRACT

A hollow tube attachable at one end to a container of fluid is provided at the other end with an end cap in which is formed a fluid discharge opening through which to transfer fluid. The end cap includes a first portion inserted into the tube, while a second portion remains exterior thereto. A slide valve on the exterior of the tube is biased into a closed position, precluding fluid transfer until the discharge opening is inside a receiving vessel. An air vent passageway in the form of an air vent recess in the outer surface of the first portion of the end cap communicates between the interior of the container and the exterior of the fluid conduit. When the receiving vessel is filled, fluid in the receiving vessel closes entry to the air vent passageway, terminating air flow into the container and stopping fluid flow through the conduit. Capillary sections of reduced cross-sectional area relative that of the air vent passageway are located at either end of the air vent recess. One is formed as an outer air vent aperture through the wall of the tube at the end of the air vent recess remote from the container; the other is formed in the outer surface of the first portion of the end cap at the opposite end of the air vent recess.

50 Claims, 11 Drawing Sheets

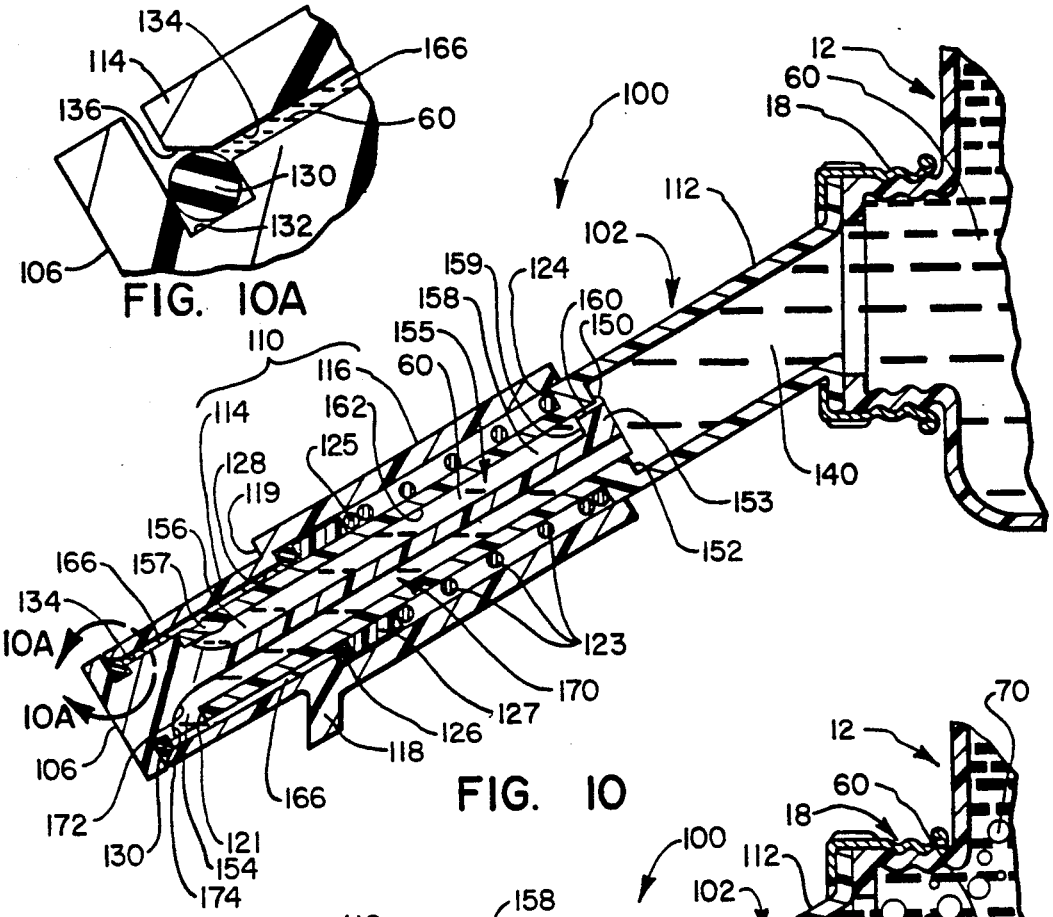
FIG. 10A
FIG. 10
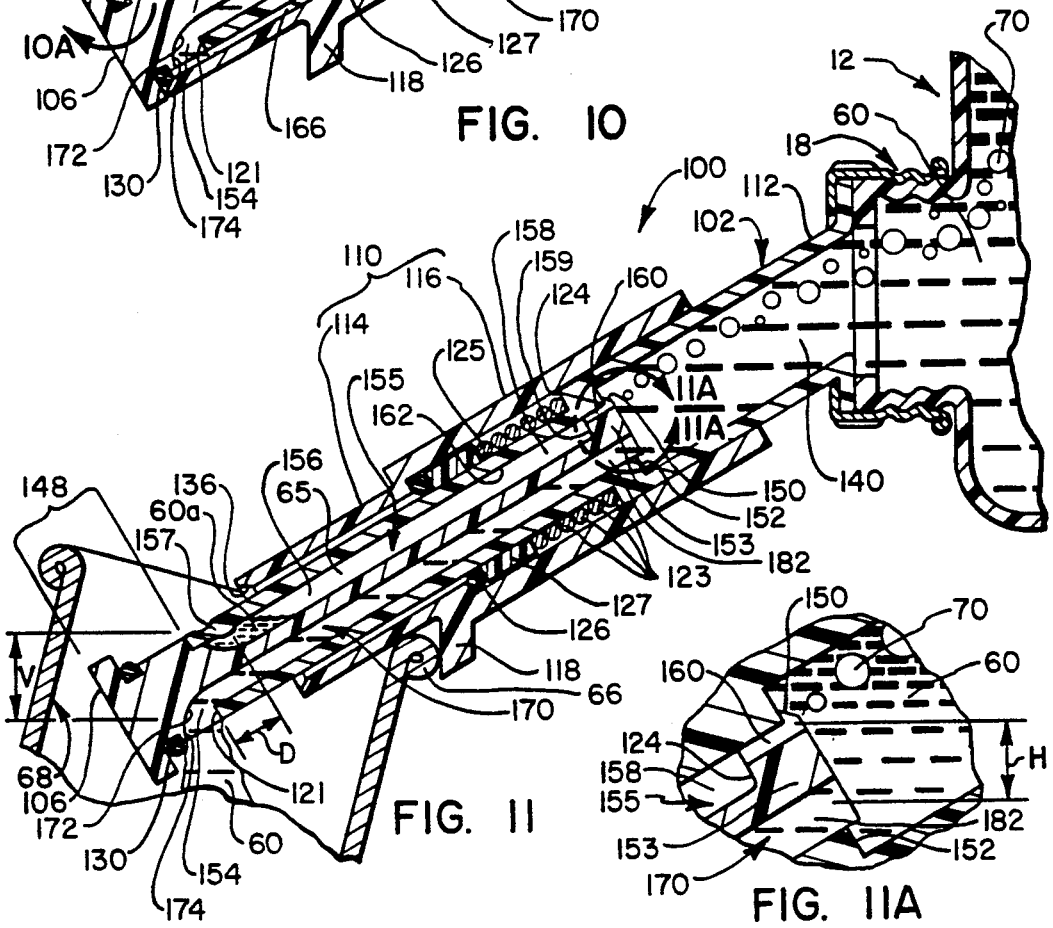
FIG. 11
FIG. 11A

POUR SPOUT

RELATED APPLICATIONS

This is a continuation-in-part application of U.S. patent application Ser. No. 361,590 filed on May 30, 1989, now U.S. Pat. No. 5,076,333, which was a continuation-in-part application of U.S. patent application Ser. No. 27,014 filed on Mar. 16, 1987, both in the name of Verl Law for an invention entitled "Pour Spout," the latter having issued on May 30, 1989, as U.S. Pat. No. 4,834,151.

BACKGROUND OF THE INVENTION

1. Field of the Invention

This invention relates to pour spouts for containers of fluid, and more particularly to pour spouts which permit transfers of fluid under the influence of gravity into a receiving vessel without the risk of spills or overflow.

2. Background Art

The instances are numerous in which a receiving vessel or tank must be filled with a fluid and the environment in which this is accomplished or the nature of the fluid itself demands that spills be minimized or totally eliminated.

A common example involves the widespread use of internal combustion engines in lawnmowers, chain saws, tractors, motorized recreational vehicles, outboard motors, and other gasoline-powered machinery employed on farms and construction sites. It is undesirable that in filling the fuel reservoirs for such devices gasoline in any appreciable quantity should be spilled. Uncontained gasoline presents health and safety risks to persons nearby, as well as a source of environmental pollution generally. Associated with other fluids, such as cooking or machine oils, pesticides, fertilizers, cleaning fluids, sealants, and even food substances are similar concerns for minimizing spills when fluids are transferred from one container to another.

In such fluid transfers, the opportunity for spills have several causes. First, where the opening into the receiving vessel is narrow, it is often the case that a stream of fluid directed thereinto will stray outside of that opening, either due to its size or to an unsteady hand. Where no facilitating pour spout or funnel is employed and the exit of the container of fluid never actually enters the opening to the receiving vessel, this problem is a continuing one throughout the entire pouring process.

Second, containers of fluid, whether or not equipped with facilitating pour spouts or used with funnels, must be tilted toward the receiving vessel in order to initiate a flow of fluid. When this tilting must occur prior to entry of the pour spout into the neck of the receiving vessel or the top of the funnel, spills are common.

In addition, many spills occur when the receiving vessel to which fluid is being transferred fills and overflows before pouring can be terminated. Such a situation is extremely common in receiving vessels having narrow-necked openings. In such structures, it is difficult for one to visually verify the level of fluid in the receiving container as pouring is occurring. Also, once fluid in the receiving vessel reaches the level of the intake neck of the receiving vessel, additional incoming fluid, rather than being received in the volume of the entire receiving vessel, fills into only in the intake neck thereof. This results in an abrupt increase in the rate of rise in the level of fluid, enhancing the likelihood of an overflow.

Another source of difficulty in controlling transferred fluids to prevent waste and spilling is that frequently the container from which the fluid is being poured is not effectively vented during the pouring process. This can result in an uneven flow of fluid, and even surges of flow which render impossible a reliable prediction of the level of the fluid in the receiving vessel. Surges of fluid flow can also cause splashing. If occurring when the receiving vessel is almost full such surges will certainly cause overflows. In addition, the turbulence created by such surges of flow in the container from which fluid is being poured can shift the weight of that container making it difficult to hold steady.

A further problem related to ineffective venting during pouring is the development of an airlock wherein a total absence of venting in combination with specific volume and viscosity parameters can result in a fluid which will not pour once its container is inverted. On occasion the air lock can be dissipated by righting the container, but such activity causes splashing of the fluid in its container, and the necessity to reenter the pour spout into the receiving vessel thereafter only increase the opportunities for spills.

While a funnel or a narrow-necked pour spout on a fluid container can to a degree reduce spills, such devices without more do not adequately eliminate spills arising due to all of the causes described above. This is particularly true in relation to overflow control in the type of fluid transfers in which fluid flows from a container into a receiving vessel under the influence of gravity exclusively, rather than under circumstances in which pumping motivates motion in the transferred fluid.

The overflow control mechanisms commonly used in service stations for controlling overflow in filling the gas tank of a vehicle are of this latter type. The effectiveness of such systems derives from the fact that the fluid transferred is being moved due to pressure, rather than gravity. By contrast, only gravity is used, for example, to induce the flow of kerosene when that fuel is transferred from a storage container at a campsite into a lantern or a cookstove. It is to such gravity-induced types of fluid transfers that the present invention pertains, and it has been found that prior to this invention, no known satisfactory configuration for a pour spout had been achieved which could consistently facilitate spill-free, clean fluid transfers.

SUMMARY OF THE INVENTION

One object of the present invention is to produce a pour spout for a container of fluid which will preclude the overflow of any receiving vessel into which that fluid is transferred.

Another object of the present invention is to produce such a pour spout which is conducive to a uniform, even-flowing of fluid into the receiving vessel, a fluid flow lacking surges which could splash fluid out of the receiving vessel or override the effects of an otherwise operable overflow prevention system.

Still another object of the present invention is to produce a pour spout such as that described above which eliminates spills of the fluid being transferred when the container from which it is to be poured has been inverted, but the pour spout has not yet been received within the opening to a receiving vessel.

It is yet an additional object of the present invention to make available for the benefit of the public a pour spout as described above which precludes the formation in an upturned container of fluid of any air lock which could interfere with the initiation of fluid flow.

Yet another object of the present invention is to produce a pour spout as described above that is efficient to manufacture.

The cumulative purpose of all the above-described objects of the present invention is to produce a pour spout permitting transfers from a container of fluid to a receiving vessel under circumstances which minimize the opportunities for spills or losses of fluid. It is the objective of the present invention to accomplish this in an environment in which the impetus for fluid flow is gravity exclusively.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, a pour spout for permitting transfers from a container of fluid to receiving vessel is provided in one embodiment of the invention comprising a fluid conduit attached at one end thereof to the container of fluid. The fluid conduit is provided at a location remote from the container with a fluid discharge opening through which fluid is transferred from the fluid conduit into the receiving vessel.

In one embodiment of the present invention, the fluid conduit comprises a conduit tube and a fluid conduit end cap in which is formed the fluid discharge opening and a discharge passageway communicating therewith from the interior of the fluid conduit. A first end of the tube is attached to and opens into the container, while the end cap is attached to and at least partially closes the second end. The discharge opening and discharge passageway are so configured that fluid transferred through the discharge opening is imparted a substantial component of momentum away from the container parallel to the longitudinal axis of the conduit.

The pour spout further comprises closure means for precluding any flow of fluid from the fluid conduit until the fluid discharge opening is inside the receiving vessel. Preferably the closure means comprises a slide valve urged into a closed position and a slide valve release means for co-acting with the receiving vessel to open the slide valve and permit fluid to flow from the fluid conduit through the fluid discharge opening when the fluid conduit is inserted into the receiving vessel.

In one embodiment, the slide valve comprises a sleeve closely conforming to the exterior surface of the fluid conduit mounted thereon for sliding motion thereupon. A valve seat is positioned on the fluid conduit on the side of the fluid discharge opening remote from the container of fluid. Bias means are provided for urging the sleeve along the fluid conduit into sealing arrangement with the valve seat. The valve seat may comprise a resilient seal, such as an O-ring or a lathe-cut seal, encircling the fluid conduit.

In addition, the invention includes a venting means for admitting air into the interior space within the fluid conduit and the container to enable an even-flowing transfer of fluid from the container. This occurs following an initial period in which the fluid is transferred through the discharge opening and being admitted into the interior space. This transfer reduces the Volume of fluid in the container, which in turn reduces the pressure of the air in the interior space. The process continues until the pressure of the air is sufficiently below atmospheric pressure to result in a back pressure adequate to substantially curtail continued transfer of fluid through the discharge opening. It is at this point that the venting means begins to admit air into the interior space, so that continued transfer of the fluid can occur. When the receiving vessel becomes filled with the fluid, that fluid obstructs the entry into the venting means and air flow into the interior space through the venting means is terminated. Due to the back pressure in the container, this effects a prompt curtailment of the continued transfer of fluid.

The venting means preferably comprises an air vent passageway communicating between the exterior of the fluid conduit and the interior space within the fluid conduit and the container of fluid in combination with an air vent passageway constriction means for retarding the entry of fluid into the air vent passageway when fluid is being transferred from the container. In this manner a column of air is advantageously retained in the air vent passageway during the transfer of fluid. The air vent passageway constriction means may comprise one or more spaced-apart capillary sections in the air vent passageway each having an individual cross-sectional area less than that of the air vent passageway itself.

As used herein, the term "air vent passageway" should be understood to refer to any channel by which air can pass according to the teachings of the present invention from the exterior of a container of fluid to the interior during transfers of fluid therefrom. Thus, an air vent passageway can include numerous and diverse structures, such as but not limited to free standing tubular structures of any cross-sectional shape whatsoever, apertures through thin-walled structures, tunnels through substantial structures and avenues for air transfer produced through the formation of recesses in one or more mating surfaces of separate articles.

In one embodiment of the inventive pour spout, the fluid conduit end cap includes an elongated first portion which is inserted into the second end of the tube and a second portion disposed exterior to the second end of the tube. The outer surface of the first portion of the end cap engages the inner surface of the second end of the tube and has formed therein an air vent recess oriented parallel to the longitudinal axis of the fluid conduit.

The end of the air vent recess remote from the container extends to a location that is inside the receiving vessel when the closure means ceases to preclude transfer of fluid from the fluid conduit. There, the air vent recess communicates with the exterior of the container through an outer air vent aperture formed through the conduit tube. The outer air vent aperture can function as one of the capillary sections described above.

The other capillary section takes the form of an inner air vent aperture formed in the outer surface of the first portion of the end cap between the end of the air vent recess adjacent the container fluid and the end of the first portion of the end cap adjacent the container. It is a primary function of the inner air vent aperture to prevent fluid that enters the conduit when the container attached thereto is inverted from also entering the air vent passageway. This retains in the air vent passageway a column of air that insures correct venting during fluid transfer.

In another aspect of the invention, a pour spout as described above is provided with inversion protection means for precluding any overflow of fluid from the end of the sleeve of the slide valve adjacent the container of fluid when the sleeve is in the closed position of the slide valve and the container is inverted.

In one embodiment, the inversion protection means comprises a resilient sleeve overflow seal slidably encircling the conduit tube on the side of the fluid discharge opening adjacent the container. The sleeve overflow seal slides on the fluid conduit with the sleeve of the slide valve. A sleeve overflow seal protection washer slidably encircles the fluid conduit on the side of the sleeve overflow seal opposite from the fluid discharge opening. The spring that biases the slide valve into a closed position is retained in compression between the sleeve overflow seal protection washer and a longitudinally fixed point on the fluid conduit. In this manner, the sleeve overflow seal is urged into engagement with the inner surface of the sleeve of the slide valve.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity in detail through the use of the following drawings in which:

FIG. 10 is a cross-sectional elevation view of the full length of the pour spout shown in FIG. 6 taken along section line 10—10 therein;

FIG. 10A is an enlarged detail view of a portion of the pour spout shown in FIG. 10;

FIG. 11 is a cross-sectional elevation view of the full length of the pour spout shown in FIG. 7 taken along section line 11—11 therein;

FIG. 11A is an enlarged detail view of a portion of the pour spout shown in FIG. 11.

DESCRIPTION OF THE PREFERRED EMBODIMENT

Figure 1:
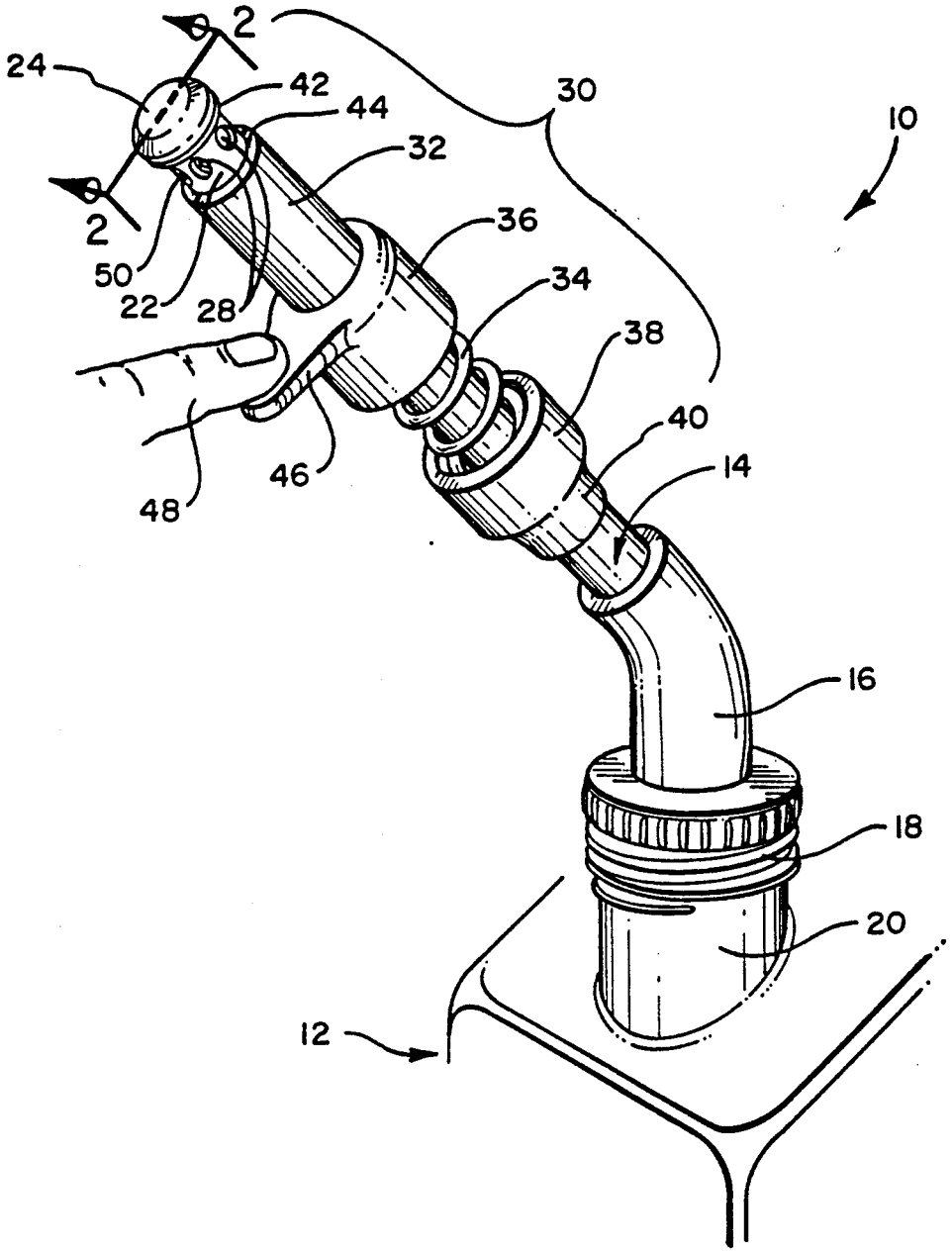
FIG. 1 is a perspective view of one embodiment of a pour spout incorporating the teachings of the present invention.
Figure 2:
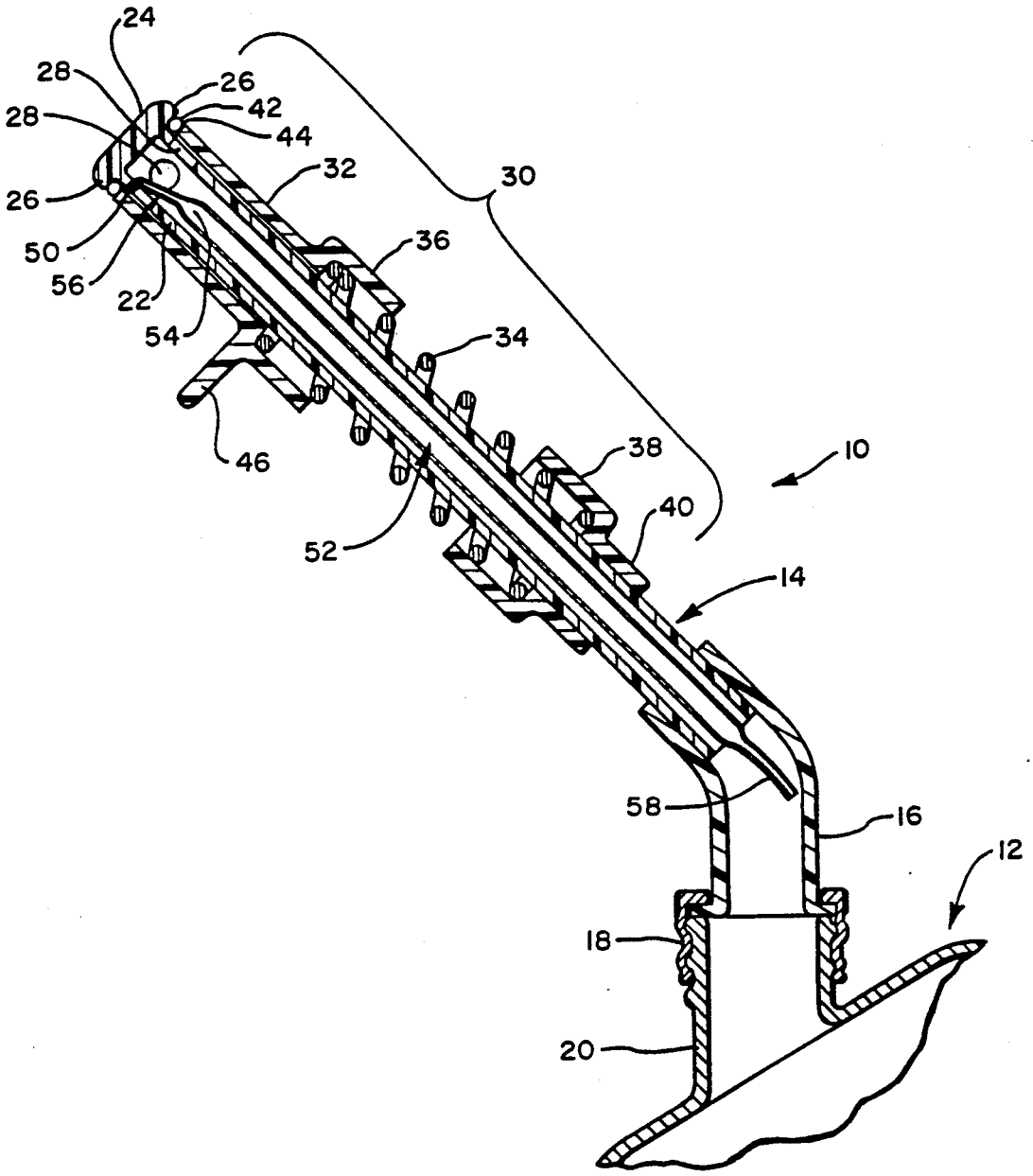
FIG. 2 is a cross-sectional view of the embodiment of the pour spout illustrated in FIG. 1 taken along the section line 2—2 therein.

FIGS. 1 and 2 taken together illustrate one embodiment of a pour spout 10 constructed according to the teachings of the present invention for permitting transfers from a container of fluid 12 while minimizing the possibility of spillage and waste of that fluid. Pour spout 10 comprises a fluid conduit 14 having one end 16 thereof attached to container 12. As used herein, the term "fluid conduit" will be used to refer to any structure, such as fluid conduit 14, through which fluid is transferred from a container, whether or not the fluid conduit is comprised of one or several components, and whether or not the passageway for fluid therethrough is straight, or as in FIGS. 1 and 2, bent at one or more portions thereof.

Pour spout 10 may be fabricated with container 12 as an integral, nonremovable portion thereof by the permanent attachment of end 16 of fluid conduit 14 to container 12. Alternatively, and as shown in FIGS. 1 and 2, pour spout 10 may be removably attached to a container, such as container 12, by any known structure capable of effecting that result. In FIGS. 1 and 2 this is shown to be possible using an annular, threaded cap 18 which cooperates with a correspondingly threaded neck portion 20 of container 12 to retain end 16 of fluid conduit 14 in selectively removable, fluid-sealing engagement therewith.

In pour spout 10 the extreme end 22 of fluid conduit 14 terminates in a laterally disposed end piece 24 which extends radially outward beyond the exterior of fluid conduit 14 in an overhanging circular lip 26, the function of which will be explained subsequently. At a location on fluid conduit 14 remote from container 12 one or more fluid discharge openings 28 are formed for permitting fluid to exit from fluid conduit 14. In most applications contemplated fluid discharge openings 28 will preferably be located near the extreme end 22 of the fluid conduit in which they are formed.

In accordance with one aspect of the present invention, closure means are provided for precluding any flow of fluid from a fluid conduit, such as fluid conduit 14, until the fluid discharge openings through which such fluid can emerge are inside the receiving vessel to which the fluid is being transferred. As shown in FIGS. 1 and 2 by way of example and not limitation, a slide valve 30 located on conduit 14 is biased into a closed position in which the flow of fluid from fluid conduit 14 through fluid discharge openings 28 is precluded. Slide valve 30 may admit of many alternate configurations, but that presently preferred for the purposes of the inventive pour spout, is shown disposed on the exterior of fluid conduit 14.

Slide valve 30 comprises a sleeve 32 closely conforming to the exterior surface of fluid conduit 14 and mounted for sliding motion thereupon. In a fluid conduit 14 dimensioned so as to have an inner diameter of approximately 0.50 inches, a difference in diameter between the outside of fluid conduit 14 and the inside of the slide valve sleeve 32 which is in the range of 0.002 to 0.003 inches has been found to be a workable clearance satisfying the several functional demands placed upon sleeve 32. Not the least of these demands is that sleeve 32 must slide freely upon fluid conduit 14 and have an adequate longitudinal dimension so as to preclude binding thereupon.

Sleeve 32 is urged along fluid conduit 14 in a direction away from container 12 by a bias means, which by way of illustration, is shown in FIGS. 1 and 2 as a spring 34 disposed encircling fluid conduit 14. Spring 34 is held in compression between an enlarged cylindrical spring retainer 36 at the end of sleeve 32 closest to container 12 and a similarly shaped, opposed spring retainer 38 at the facing end of a collar 40 rigidly attached to fluid conduit 14 at a longitudinally fixed point thereupon. In this manner, spring 34 urges sleeve 32 along fluid conduit 14 in a direction away from container 12. Movement of sleeve 32 off extreme end 22 of fluid conduit 14 is blocked by lip 26 of end piece 24, which functions as the valve seat for slide valve 30. When sleeve 32 is against lip 26, spring 34 is in its state of longest extension but is still in a state of relative compression. To enhance the sealing effect of slide valve 30, a resilient O-ring 42 may be retained encircling fluid conduit 14 between lip 26 and fluid discharge openings 28. The leading edge 44 of sleeve 32 then is forced into sealing engagement with O-ring 42 by spring 34 in the closed position of slide valve 30. With slide valve 30 in its closed position, fluid discharge openings 28 are blocked, precluding any flow of fluid from fluid conduit 14 until the biasing effect of spring 34 is overcome.

In accordance with yet another aspect of the invention, the closure means partially described above is further provided with a slide valve release means for co-acting with a receiving vessel for fluid from container 12 in order to open slide valve 30 and permit fluid to flow from fluid conduit 14 through fluid discharge openings 28 which are otherwise blocked by the slide valve in its closed position. By way of example, a simple form of such a slide valve release means can be seen in FIGS. 1 and 2 to comprise a projection 46 secured to sleeve 32 for catching the lip of a receiving vessel when pour spout 10 is inserted thereinto. As pour spout 10 is advanced into the receiving vessel, sleeve 32 is drawn out of engagement with its valve seat, in this instance with O-ring 42. It is thus the relative motion between a container of fluid, such as container 12, and the inlet to a receiving vessel that serves to open slide valve 30 and permit fluid flow through pour spout 10.

FIG. 1 illustrates the relationship of the parts of pour spout 10 when such relative motion has overcome the bias of spring 34 and sleeve 32 is no longer in the closed position of slide valve 30. In the instance illustrated in FIG. 1, however, the force upon projection 46 necessary to effect such a result is being applied by a finger 48 of an operator. The same operation is nevertheless effected when end 22 of fluid conduit 14 is moved into a receiving vessel so that projection 46 co-acts therewith. Such operation will be described in detail subsequently. In FIG. 2, finger 48 of an operator has been removed from projection 46, and slide 32 can there be seen to be again urged into the closed position of slide valve 30.

In accordance with yet another aspect of the invention, a pour spout, such as pour spout 10, is provided with venting means for admitting air into the interior space within the fluid conduit of the pour spout and the container of fluid with which it is employed to facilitate an even-flowing transfer of fluid from the discharge opening. The venting means operates in this manner only after an initial period in which fluid transfers through the discharge opening without any air being admitted into the interior space. This transfer reduces the volume of fluid in the container, which in turn reduces the pressure of air in the interior space. The process continues until the pressure of the air in the interior space is sufficiently below atmospheric pressure to result in a back pressure adequate to substantially curtail continued transfer of fluid through the discharge opening.

Thereafter, this back pressure is maintained, but the venting means begins admitting air into the interior space. This allows for a continued even flow of fluid. When the receiving container becomes filled, the surface of the fluid transferred thereinto rises to obstruct the entry into the venting means. The flow of air into that interior space then terminates. This combines with the back pressure already created in the container to promptly curtail the flow of fluid out of the pour spout. In this manner automatic overflow protection is effected.

By way of illustration, and not limitation, one embodiment of such a venting means for use with a pour spout according to the present invention is best seen in FIG. 2 to comprise an air vent opening 50 formed in fluid conduit 14 and an air vent tube 52 preferably disposed within fluid conduit 14 communicating at one end 54 thereof with air vent opening 50. These structures together constitute an example of an air vent passageway according to the teachings of the present invention. While air vent tube 52 is shown in FIG. 2 as being entirely disposed within fluid conduit 14, such an arrangement is merely preferred, but not essential, to the satisfactory functioning of the inventive pour spout.

Air vent opening 50 is so located on fluid conduit 14 so as to be within a receiving vessel whenever sleeve 32 is drawn out of sealing engagement with its corresponding valve seat by the co-action of projection 46 with the receiving vessel. Under most circumstances envisioned this would require that air vent opening 50 be in relatively close longitudinal proximity on fluid conduit 14 to fluid discharge openings 28. While such a relative relationship among air fluid discharge openings 28 and vent opening 50 is illustrated in FIGS. 1 and 2, alternate arrangements are workable. For example, air vent opening 50 could be more remote or more proximate to a container of fluid, such as container 12, than are fluid discharge openings 28. The implication of this variable aspect of the invention will become clear when the operation thereof is described below. For the present, however, it suffices to indicate that one function of air vent tube 52 is to admit air into the interior space within fluid conduit 14 and container 12 to facilitate an even-flowing transfer of the fluid out of container 12 through pour spout 10.

The venting means suitable for use with a pour spout, such as pour spout 10, further comprises an air vent tube constriction means for retarding the entry of fluid into air vent tube 52 when fluid is being transferred from the pour spout. This results in retaining a column of air in air vent tube 52 during each transfer of fluid from pour spout 10. The utility of this result will be described subsequently. As fluid initially is transferred from container 12 through pour spout 10 without air entering container 12 through air vent tube 52, the pressure of the air in the interior space in container 12 and pour spout 10 is reduced to less than the ambient pressure of the atmosphere outside of container 12. Thereafter, while the interior space becomes vented through air vent tube 52, the back pressure is maintained within container 12 and assists in the fluid flow curtailment function of the venting means.

As shown in FIG. 2, with additional specificity, but by no means by way of limitation, such an air vent tube constriction mean s comprises at least one capillary section in air vent tube 52 having an inside diameter less than that of air vent tube 52. In FIG. 2, two such capillary sections 56, 58 are shown integrally formed in air vent tube 52. Capillary section 56 is located at air vent opening 50, while capillary section 58 is located at the end of air vent tube 52 remote therefrom. For optimum functioning of the air vent means of the present invention in all its diverse aspects, it is desirable that the inside diameter of capillary sections 56, 58 be substantially identical. Capillary sections 56, 58 need not, however, be of equal length to ensure optimum functioning of the device. While capillary sections 56, 58 are shown in FIG. 2 as separated from each other, a suitable airflow constriction means is conceivable for specific combinations of fluid viscosity and lengths of an air vent tube as would require the capillary portions to encompass the entire length of the air vent tube.

Figure 3A:
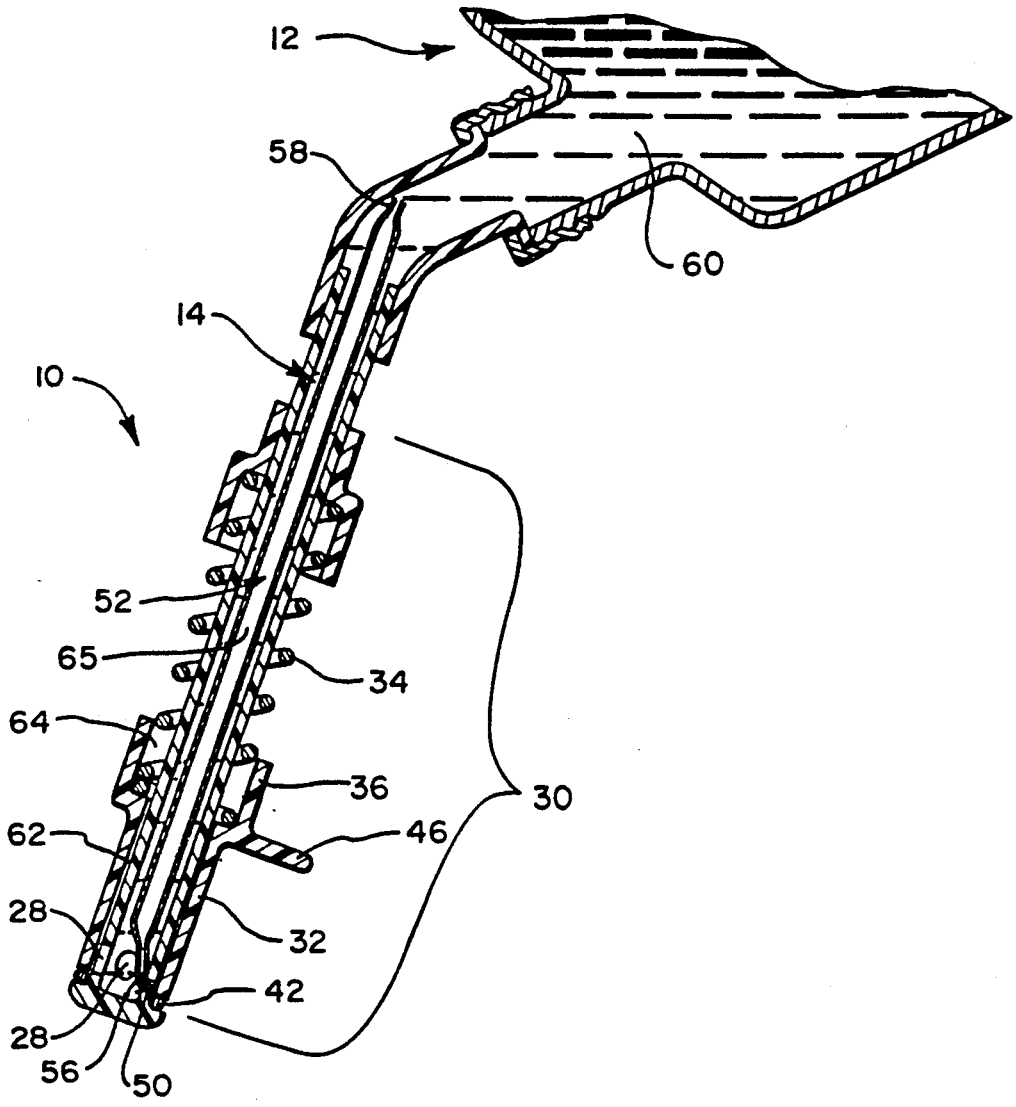
FIG. 3A is a cross-sectional view of the pour spout shown in FIG. 1 in a first stage of operation.

The operation of a pour spout according to the present invention, such as pour spout 10, will now be described in detail in relation to FIGS. 3A, 3B, and 3C in sequence. In FIG. 3A, container 12 holding a reservoir of fluid 160 has been upturned in preparation for transferring a portion of fluid 160 into a receiving vessel. Fluid 160 thus fills the portion of fluid conduit 14 exterior to air vent tube 52. Due to the action of spring 34, sleeve 32 is in the closed position of slide valve 30 urged against O-ring 42, and fluid 60 is in theory precluded from escaping through fluid discharge openings 28 by the inner surface of sleeve 32.

In actual fact, however, unless the fit between sleeve 32 and fluid conduit 14 is exact, a condition which could be predicted to preclude easy sliding of sleeve 32 on fluid conduit 14, fluid does seep through fluid discharge openings 28 into the interstitial space 62 between sleeve 32 and the outer surface of fluid conduit 14. The seepage of fluid 60, is nevertheless sufficiently slow due to the close fit between sleeve 32 and the outer surface of fluid conduit 14 as to adequately serve the purposes of the pour spout 10. For the clearances described already, inverted positioning, such as that shown in FIG. 3A, for a period of approximately thirty seconds would be required until seepage of fluid 60 filled all of interstitial space 62, as well as the cup-like space 64 within spring retainer 36. By that point in time, however, further operation of pour spout 10 will normally have occurred, eliminating any fluid 60 within interstitial space 62. In addition to permitting sleeve 32 to slide upon fluid conduit 14, interstitial space 62 permits the venting of container 12 when stored in its upright position, thereby preventing an dangerous buildup of pressure therewithin.

When container 12 is inverted, fluid initially flows through discharge openings 28, creating a back pressure in container 12 in the space 72 above fluid 60. No air flows through air vent tube 52 for relieving the developing back pressure until such time as that back pressure is sufficiently less than atmospheric pressure to curtail any continued transfers of fluid from fluid drainage discharge 28. At this point, the negative pressure in space 72 is approximately equal to the fluid head pressure developed between the top surface of fluid 60 and fluid discharge openings 28. Under such circumstances, air will begin to enter through air vent tube 52 to permit a continued even-flowing transfer of fluid 60. An arrangement of equipment for demonstrating this sequence of events will be described subsequently.

If air vent opening 50 is located relatively close to the end of fluid conduit 14, then fluid 60 seeping through fluid discharge openings 28 into interstitial space 62 will promptly enter air vent opening 50 and fill capillary section 56 of end 54 of air vent tube 52. This will prevent any air entrapped in air vent tube 52 when container 12 is inverted from escaping through air vent opening 50. The fluid head at the open end of capillary section 58 present due to the reservoir of fluid 60 housed in container 12 in combination with the reduced inner diameter of capillary section 58 will prevent the escape of air from air vent tube 52 through the end thereof remote from air vent opening 50. The result will be a static condition in which an air column 65 is trapped in air vent tube 52 awaiting the next phase of pour spout operation.

The effect of column 65 trapped in air vent tube 52 is critical in two respects to ensuring the prompt flow of fluid during the next stage of operation, when slide 32 is retracted by the co-action of projection 46 with the opening to the receiving vessel for fluid 60. First, column 65 trapped in air vent tube 52 prevents air vent tube from filling up with fluid 60, which would seriously undermine the ability air vent tube 52 to admit air into the interior space within fluid conduit 14 and container 12. Were air vent tube 52 to fill with fluid 60, like the rest of fluid conduit 14, the fluid head pressure at air vent opening 52 due to the reservoir of fluid 60 thereabove in container 12 would be equal to the fluid head pressure at fluid discharge openings 28. With no differential in head pressure between the fluid discharge openings 28 and the air vent opening 50, no air could enter container 12 to relieve back pressure on fluid 60 even with sleeve 32 retracted. Fluid 60 would not flow, or if it did so, flow would commence on an unpredictable basis.

Most individuals are familiar with the phenomenon in which an upturned full bottle of catsup will not permit its contents to emerge. Those contents are normally freed either by shaking the bottle, which imparts to the contents thereof adequate momentum to overcome the back pressure created in the top of the bottle by their escape, or by venting the top of the bottle so that air may be exchanged volume-for-volume by any catsup that does pour out. The latter is usually accomplished by tilting back the bottle to one side to permit an air passageway to the interior of the bottle to develop along the upper surface of the neck of the bottle. Under circumstances contemplated for fluid transfers with the inventive pour spout, however, neither shaking nor back tilting are considered acceptable means for initiating the flow of fluid.

The contents of a bottle of catsup that cannot be extracted due to an air lock condition such as that described above, could alternatively be made to flow, if a thin venting tube were extended through the mouth of the inverted bottle and the catsup to the air space within the bottle thereabove. Nevertheless, were this venting tube to be filled with catsup, the bottle would still not be provided with the venting action required to initiate catsup flow. The fluid head in the filled venting tube and outside it in the filled bottle neck would be equal. Only a differential between the fluid pressure at the open end of the bottle and the exposed end of the venting tube could commence the flow of catsup. Suction or air pressure at one or the other of these two locations would be required to overcome the static condition of the fluid. Otherwise, the user would merely have to be content to wait until some shift in the fluid stasis were to occur, breaking the air lock in the bottle.

In the inventive pour spout, by contrast, air column 65 trapped in air vent tube 52 prevents such venting dysfunctions. The air column 65 creates a head pressure differential between fluid discharge openings 28 and air vent opening 50 due to the difference in head pressure created by air column 65 and the corresponding column of fluid 60 in fluid conduit 14 outside air vent tube 52. The head pressure at fluid discharge openings 28 in the static position depicted in FIG. 3A is that arising due to the full height of the fluid 60 standing above fluid discharge openings 28. On the other hand, the head pressure at air vent opening 50 is in substance equal only to the head pressure developed by the amount of fluid 60 standing above capillary section 58 at the end of air vent tube 52 remote from air vent opening 50.

This is because within air vent tube 52, between capillary section 58 and capillary section 56, no column of fluid 60 is present. Air column 65 adds a negligible amount of head pressure to that exerted on the small quantity of fluid closing capillary section 54 at air vent opening 50. Thus, the head pressure at capillary section 52 is equal to that exerted at capillary section 58, which is transmitted thereto through the compressible air column 65. As the head pressure in fluid 60 at capillary section 58 will always be less than head pressure appearing at fluid discharge openings 28 at the far end of fluid conduit 14, the opening of slide valve 30 will result in fluid flow, promptly, consistently, and continuously through fluid discharge openings 28, while air is drawn inward through air vent tube 52 into the space in container 12 above fluid 60.

Figure 3B:
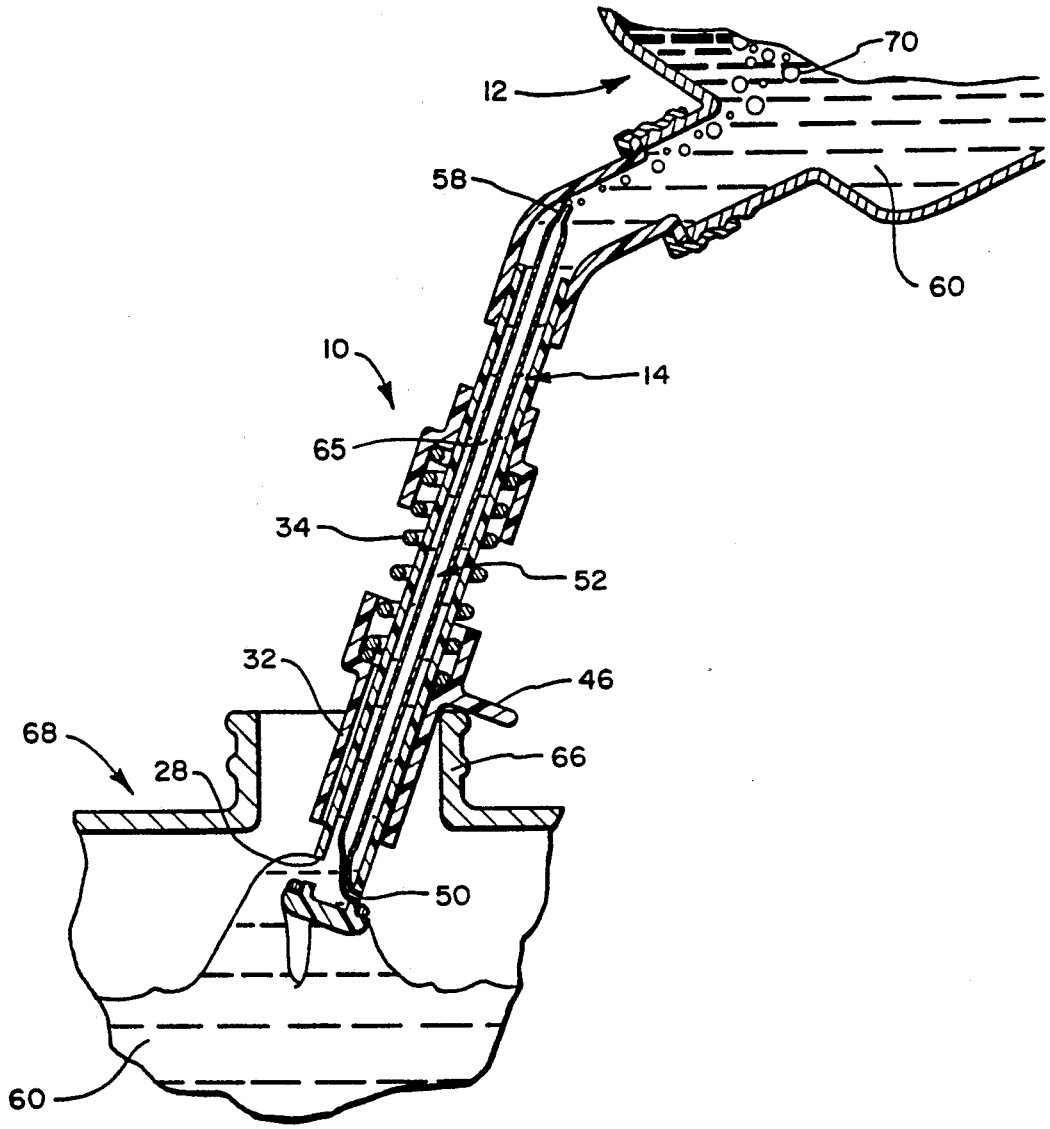
FIG. 3B is a cross-sectional view of the pour spout of FIG. 1 shown in a second stage of operation.

This dynamic state is depicted in FIG. 3B. There, projection 46 secured to sleeve 32 has engaged lip 66 of the opening to a receiving vessel 68 for fluid 60. As container 12 and pour spout 10 attached thereto are further advanced into receiving vessel 68, relative motion between sleeve 32 and fluid conduit 14 occurs, overcoming the bias of spring 34. In this process, it is normally adequate for the operator to merely rest pour spout 10 within receiving vessel 68, so that projection 46 engages lip 66 and then to permit the cumulative weight of container 12 with fluid 60 therein to descend compressing spring 34.

Support of the weight of container 12 in this manner would, however, suggest that pour spout 10, or at least fluid conduit 14 and slide 32 thereof, be made of a relatively sturdy material capable of bearing weight of such a magnitude. In instances where the use of pour spout 10 is contemplated with flammable fluids, a non-ferrous material, such as copper or sturdy plastic, is further recommended so as not to cause fluid-igniting sparks should pour spout 10 be struck accidentally against concrete or a ferrous material.

In any case, once sleeve 32 has been drawn toward container 12 exposing fluid discharge openings 28, fluid 60 will flow through these into receiving vessel 68, until sufficient back pressure is developed in space 72 above fluid 60 to substantially curtail continued fluid transfer, and then to induce air flow through air vent tube 52. Air drawn through air vent tube 52 into container 12, is indicated by bubbles 70 emerging from capillary section 58 of air vent tube 52. The back pressure above fluid 60 is maintained during the subsequent even flowing transfer of fluid during which time the volume of fluid flowing out of container 12 is substantially equal to the volume of air flowing thereinto through air vent tube 52. In this position of slide 32, any fluid 60 which seeped through fluid discharge openings 28 into interstitial space 62 or space 64 within spring retainer 36 will drain away into receiving vessel 68.

For the purpose of properly entrapping the bubble of air in air vent tube 52 when fluid container 12 is upturned, it has been found that the inner diameter of air vent tube 52 should be at least 1.5 times, and preferably at least 2.0 times, the inner diameter of any capillary sections therein, such as capillary sections 56, 58. In a pour spout having a fluid conduit 14 with an inner diameter of 0.50 inches and five fluid discharge openings 28 each having an inner diameter of 0.218 inches, capillary sections, such as capillary sections 56, 58, having inner diameters of 0.070 inches have proved entirely satisfactory when used with a container 12 holding gasoline.

The purpose of creating and maintaining back pressure above fluid 60 is to afford enhanced responsiveness in shutting of continued fluid flow when receiving vessel 68 becomes filled. When airflow through air vent tube 52 is terminated, the back pressure above the reservoir of fluid 60 causes fluid flow through fluid discharge openings 28 to cease almost simultaneously. No delay or passage of fluid out of conduit 14 is required in order to generate the back pressure above fluid 60 with which to terminate its flow. This back pressure is present with the pour spout of the present invention, even in the dynamic pouring state illustrated in FIG. 3B.

Figure 3C:
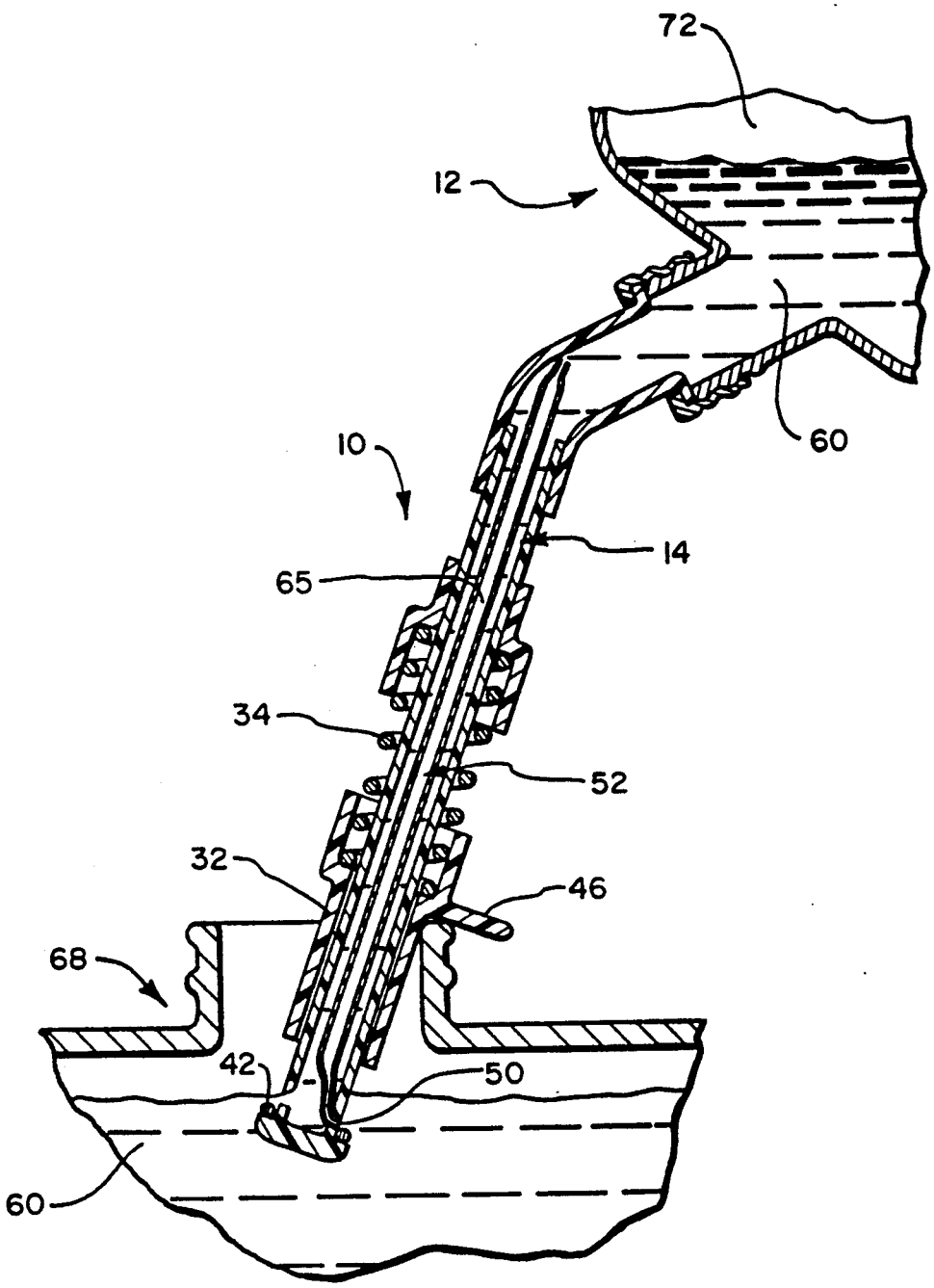
FIG. 3C is a cross-sectional view of the pour spout of FIG. 1 shown in a third and final stage of operation.

The stoppage of fluid flow is depicted in FIG. 3C. There, the level of fluid 60 in receiving vessel 68, has risen, due to the transfer of fluid 60, to a point at which fluid 60 obstructs air vent opening 50, thereby terminating air flow through vent tube 52 into the interior of container 12. The partial vacuum in space 72 above fluid 60 in container 12 exerts back pressure upon the further flow of fluid 60 from fluid conduit 14, and a condition of fluid stasis again results.

The operator of a pour spout, such as pour spout 10, need not peer into the opening into receiving vessel 68, or anxiously await the overflow of fluid 60 therefrom. Instead, after inserting pour spout 10 into receiving vessel 68, the operator can be secure in the knowledge that when receiving vessel 68 has filled with fluid 60 to the point that air vent opening 50 at the end of pour spout 10 is covered by fluid 60, all flow will stop. Thereafter, lifting of container 12 will remove pour spout 10 from receiving vessel 68, and the bias of spring 34 will return sleeve 32 into sealing engagement with O-ring 42. This thereafter prevents any loss of fluid from fluid discharge openings 28 during the time that container 12 is being returned to the upright.

Thus, the venting means of the present invention is one that not only admits air into the interior space within the container from which fluid is being dispensed after a negative pressure is developed thereabove, but the venting means also terminates air flow into the interior space when the receiving container for that fluid becomes filled. This effects a prompt curtailment of fluid flow through the fluid conduit into the receiving vessel. This overflow protection keeps excess fluid from emerging as overflow out of the receiving container.

The operation of an air vent tube, such as air vent tube 52, in conjunction with at least one capillary section, such as capillary sections 56 or 58, is so advantageous in venting of a container of fluid and in preventing overflow when fluid is transferred from that container into a receiving vessel, that such an air vent tube has utility in pour spouts, apart from the inclusion therein of any slide valve, such as slide valve 30. Under such circumstances, the air vent tube communicates between the space exterior to fluid conduit 14 at a location adjacent fluid discharge openings 28 and the interior space within container 12. Satisfactory venting and a limited form of overflow protection would then be available, provided that the end of fluid conduit 14 were located within the receiving vessel during the transfer of fluid and withdrawn therefrom in a quick motion simultaneously upturning container 12 once flow from container 12 had terminated. While a device of this type would not provide the complete spill protection afforded in pour spout 10 with slide valve 30, it would nevertheless be an improvement over some existing pour spout devices and is accordingly considered to be part of the inventive pour spout. In such a configuration, air vent tube 52 could for a substantial portion of its length also be located on the exterior of fluid conduit 14.

Figures 4, 4A:
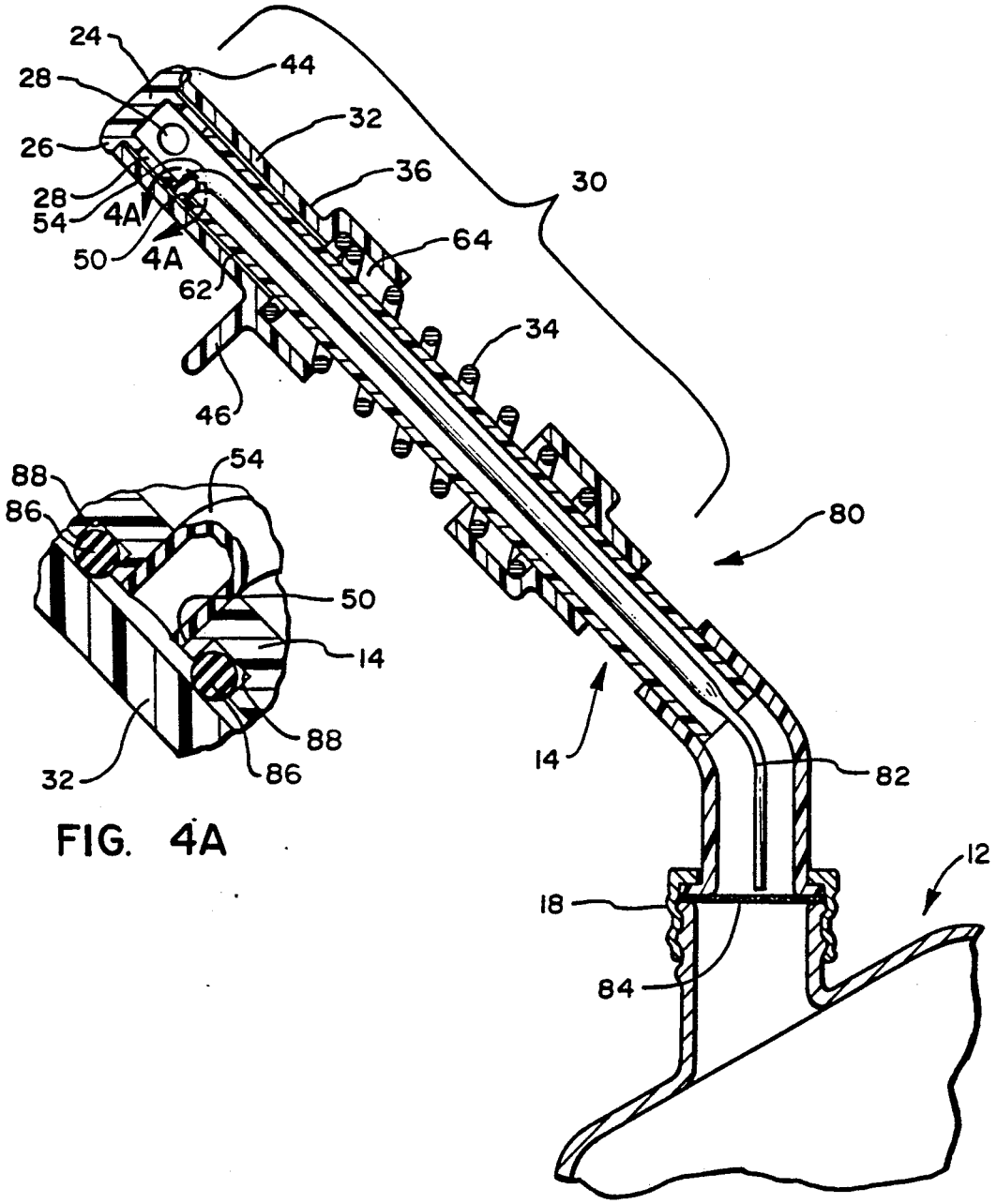
FIG. 4 is a cross-sectional view of a second embodiment of a pour spout embodying teachings of the present invention.
FIG. 4A is an enlarged detail view of a portion of the pour spout shown in FIG. 4.

FIG. 4 depicts yet another embodiment of a pour spout 80 constructed according to the teachings of the present invention. Only the manner in which the structure of pour spout 80 distinguishes from that of pour spout 10 will be discussed, and identical structures will continue to be identified by the reference characters used in relation to the device of FIGS. 1 and 2. Pour spout 80 is shown removably attached to a container of fluid 12.

In contrast to pour spout 10, the leading edge 44 of sleeve 32 seats directly against lip 26 of end piece 24, which functions as the valve seat of slide valve 30. Also, air vent opening 50 is located closer to container 12 than are fluid discharge openings 28. This will have the effect of permitting fluid transferred into a receiving vessel to fill the receiving vessel higher in the neck of the opening thereinto than would a pour spout, such as pour spout 10, in which air vent opening 50 and fluid discharge openings 28 are at approximately the same longitudinal location on fluid conduit 14. In addition, air vent tube 52 in pour spout 80 is provided with only one capillary section 82, which while longer than corresponding capillary section 58 in FIG. 2, is still contained within the body of fluid conduit 14. The attachment of pour spout 80 to container 12 has been enhanced by the addition of a flash screen 84 to prevent entry of debris that might obstruct the proper functioning of capillary section 82.

As illustrated in the detail view shown in FIG. 4A, the end 54 of air vent tube 52 at air vent opening 50 does not narrow into a capillary section. Therefore, the fluid seal which develops in pour spout 10 at capillary section 56 when fluid container 12 is upturned to prevent the escape of air from fluid container 52, is not available in pour spout 80. In many instances, if the size of capillary section 82 is adequately small, this will not be a problem, as fluid seeping through fluid discharge openings 28 into interstitial space 62 between sleeve 32 and fluid conduit 14 will nonetheless fill air vent tube 52 at air vent opening 50 in due course, stopping the escape of air in that direction.

Even if a fluid seal at air vent opening 50 is effected, an air column in air vent tube 52 will not be securely entrapped, because the difference in internal cross section between end 54 of air vent tube 52 and capillary section 82 does not produce stasis. Rather, the pneumatic advantage created by those differing cross sections will gradually migrate the bubble of air in air vent tube 52 upward therein and possibly entirely out of capillary section 82. In theory, this process should only proceed to such a height as fluid 60 can rise in interstitial space 62 and space 64 within spring retainer 36.

Nevertheless, to prevent this, and to provide pour spout 80 with the full range of functional features found in pour spout 10, a mechanical, air tight seal may be provided at air vent opening 50 that closes air vent opening 50 at a point prior to or when sleeve 32 engages the valve seat of slide valve 30. Such an air tight seal could take the form of a resilient O-ring 86 retained in a groove 88 on the outer surface of fluid conduit 14 encircling air vent opening 50, as is illustrated in the detail to FIG. 4. Other forms of such a seal will be disclosed hereinafter.

Figures 5, 5A:
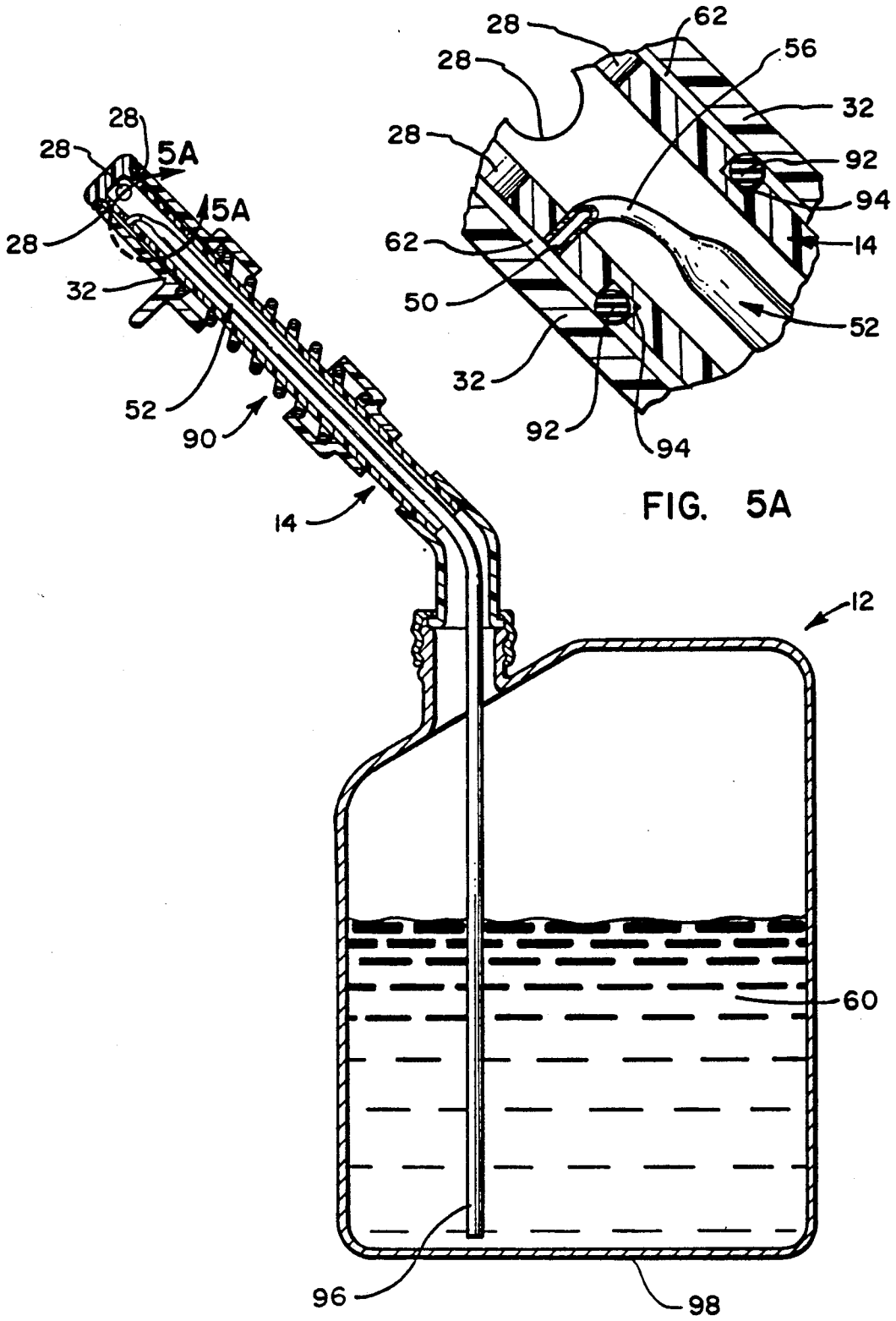
FIG. 5 is a cross-sectional view of a fluid container having attached thereto a third embodiment of a pour spout incorporating teachings of the present invention.
FIG. 5A is an enlarged detail view of a portion of the pour spout shown in FIG. 5.

Yet another embodiment of a pour spout 90 embodying teachings of the present invention is shown in FIG. 5 attached to a container 12 for fluid 60. Again, only the manner in which the structure of pour spout 90 differs from that of pour spout 10 will be discussed in any detail, and the structure of pour spout 90 identical to that of pour spout 10 will be referred to by correspondingly identical reference numerals.

As described earlier, when a container 12 using a pour spout according to the present invention is inverted, as in FIG. 3A, fluid 60 from within container 12 slowly seeps through fluid discharge openings 28 into the interstitial space 62 between sleeve 32 and fluid conduit 14, shown in the detail to FIG. 5. The possibility of fluid 60 in this manner ultimately escaping pour spout 90 can be entirely prevented by the provision of an auxiliary seal between sleeve 32 and the exterior surface of fluid conduit 14.

Such an auxiliary seal is shown in FIG. 5A in the form of a resilient O-ring 92 retained in a groove 94 encircling fluid conduit 14 on the side of fluid discharge openings 28 and air vent opening 50 adjacent container 12. Such a sealed pour spout 90 would have the additional advantage of not venting container 12 were container 12 to be stored indoors containing a fluid 60 emitting objectionable vapors.

In FIG. 5A air vent tube 52 is seen to be provided with a single capillary section 56 which is located at air vent opening 50 in the manner shown in FIG. 1. The end 96 of air vent tube 52 remote from air vent opening 50 does not contain any capillary section. This can be compensated for to a degree, if air vent tube 52 is extended beyond fluid conduit 14 into close proximity with the bottom 98 of container 12. Under most circumstances, when container 12 is inverted, end 96 of air vent tube 52 will be above the surface of fluid 60, and air vent tube 52 will function adequately to vent the interior space of container 12 when fluid is flowing out of fluid conduit 14.

A possibility for disfunction exists, however. As end 96 of air vent tube 52 extends into fluid 60 when container 12 is upright, a certain quantity of fluid 60 will be trapped in air vent tube 52 when container 12 with pour spout 80 attached thereto is inverted. If this quantity of fluid fills air vent tube 52 to precisely the height of the surface of fluid 60 in container 12 in that inverted position, then the head pressure, both at fluid discharge openings 28 and at air vent opening 50, will be equal. An air lock and a delayed initiation of fluid flow will result. Despite such disadvantageous functioning, pour spout 90 is in other respects adequately advantageous over known pour spouts, that the configuration shown in FIG. 5 is nevertheless considered to be within the scope of the inventive pour spout disclosed.

Figure 6:
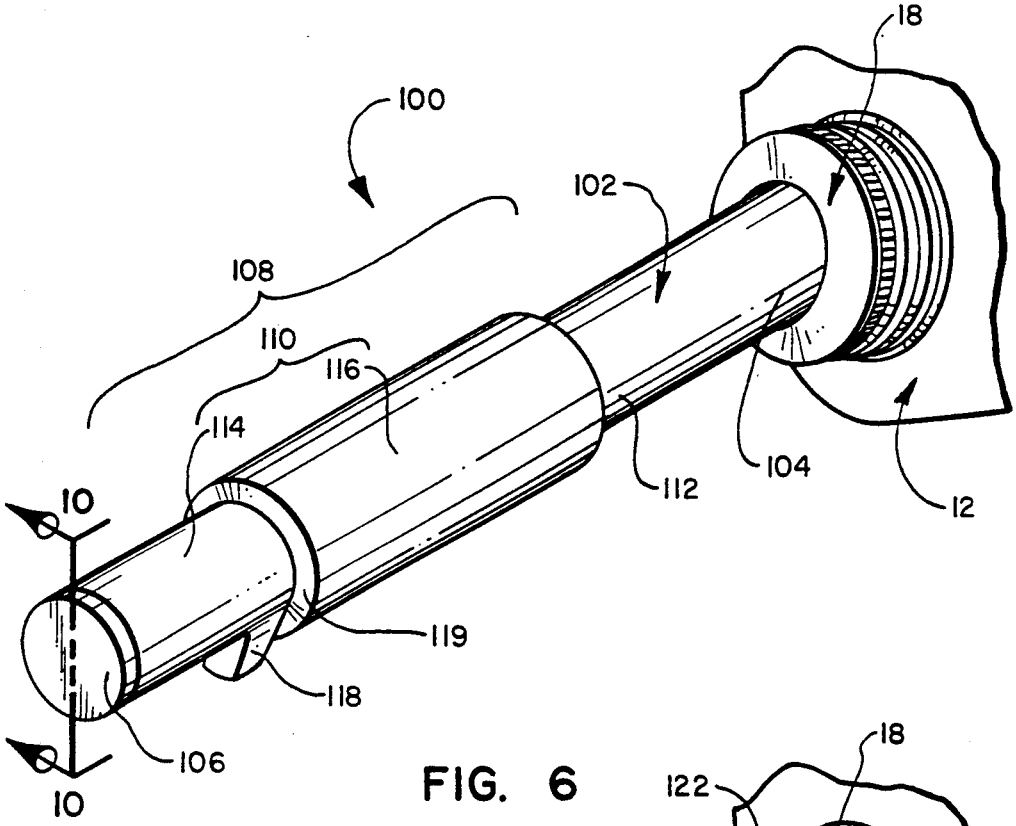
FIG. 6 is a perspective view of a fourth embodiment of a pour spout incorporating teachings of the present invention with the slide valve thereof in its closed position.

FIG. 6 depicts a fourth embodiment of a pour spout 100 incorporating teachings of the present invention. Pour spout 100 comprises a fluid conduit 102 having one end 104 thereof attached to container 12 using an annular, threaded cap 18 and a correspondingly threaded neck portion (not shown) of container 12. Alternatively, pour spout 100 may be fabricated with container 12 as an integral, non-removable portion thereof.

Remote end 106 of fluid conduit 102 is provided with a fluid discharge opening not shown in FIG. 6, but is disclosed in detail subsequently. Through this fluid discharge opening, the fluid in container 12 can be transferred into a receiving vessel. In accordance with one aspect of the present invention, a closure means is provided for precluding any such transfer of the fluid from fluid conduit 102, until the fluid discharge opening thereof is inside the receiving vessel. The exterior of such a closure means is shown by way of example in FIG. 6 as comprising a slide valve 108 taking the form of a sleeve 110 closely conforming to the exterior surface 112 of fluid conduit 102 and mounted for sliding motion thereupon. In FIG. 6, slide valve 108 is shown in the closed position thereof in which transfer of fluid from fluid conduit 102 is precluded.

The end of sleeve 110 remote from container 12 takes the form of a tubular portion 114 which effects actual sliding contact with exterior surface 112 of fluid conduit 102 and in the closed position of slide valve 108 terminates in sealing engagement with remote end 106 thereof. Integrally formed with tubular portion 114 at the end thereof closest to container 12 is a cylindrical skirt portion 116 of sleeve 110, which has a diameter enlarged in relation to that of tubular portion 114. As will be disclosed in relation to further figures, skirt portion 116 encloses and conceals a bias means for urging slide valve 108 into the closed position thereof illustrated in FIG. 6.

In accordance with another aspect of the closure means of the present invention, a slide valve release means is provided for co-acting with a receiving vessel to move slide valve 108 out of the closed position as remote end 106 of fluid conduit 102 and the discharge opening therein enter into the receiving vessel. As shown by way of example and not limitation, a projection 118 is secured to sleeve 110 at a juncture 119 between tubular portion 114 and skirt portion 116. Projection 118 catches the lip of any receiving vessel into which fluid from container 12 is to be transferred. As remote end 106 of fluid conduit 102 is thereafter advanced into the receiving vessel, projection 118 draws sleeve 110 along the exterior of fluid conduit 102 towards container 12 and out of the closed position of slide valve 108.

Figure 7:
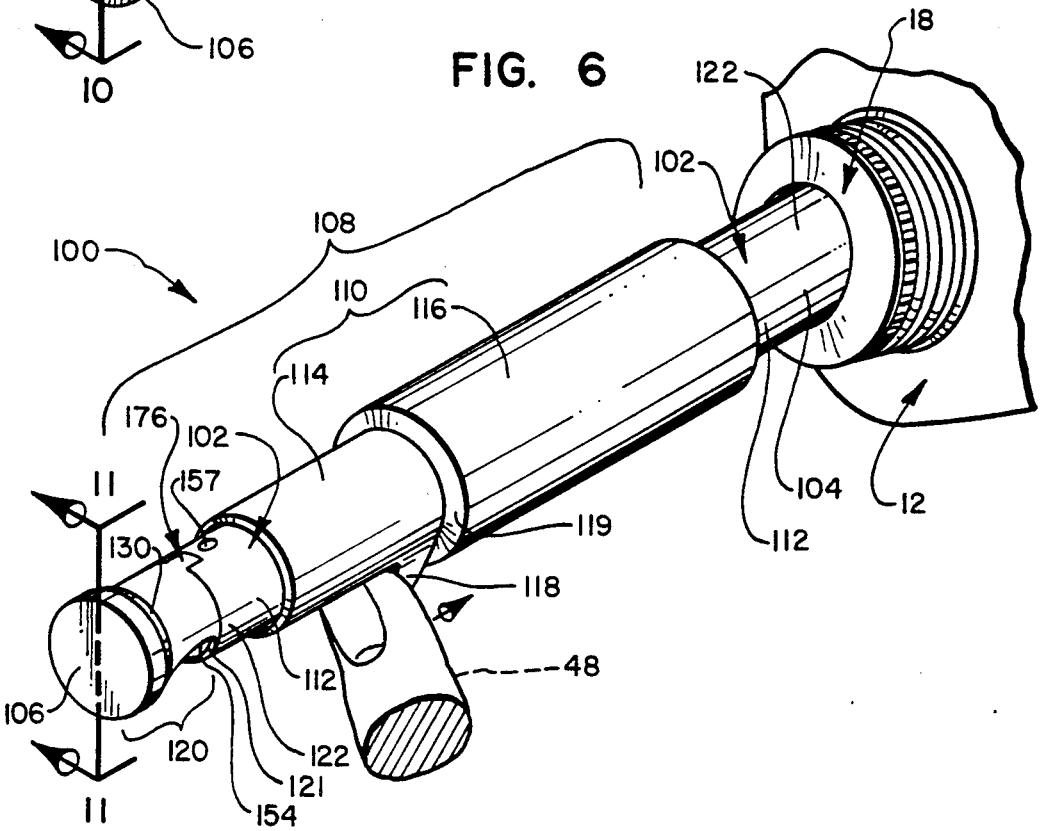
FIG. 7 is a perspective view of the pour spout of FIG. 6, with the slide valve thereof in its open position.

FIG. 7 illustrates the relationship of the parts of pour spout 100 when such relative motion has overcome the bias means normally operative on slide valve 108, and sleeve 110 is no longer in the closed position of slide valve 108. In the instance illustrated in FIG. 7, however, the force upon projection 118 necessary to effect such a result is being applied by a finger 48 of an operator. The same operation is nevertheless effected when remote end 106 of fluid conduit 102 is moved into a receiving vessel, so that projection 118 co-acts therewith.

In FIG. 7, movement of sleeve 110 from the position illustrated in FIG. 6 under the influence of the force applied by finger 48 reveals that remote end 106 of fluid conduit 102 is the terminus of a fluid conduit end cap 120 which is attached to and at least partially closes the free end 121 of a tube 122. Tube 122 comprises substantially most of the length of fluid conduit 102 terminating at cap 18 where tube 122 is secured to container 12 in a conventional manner.

Figures 8, 9:
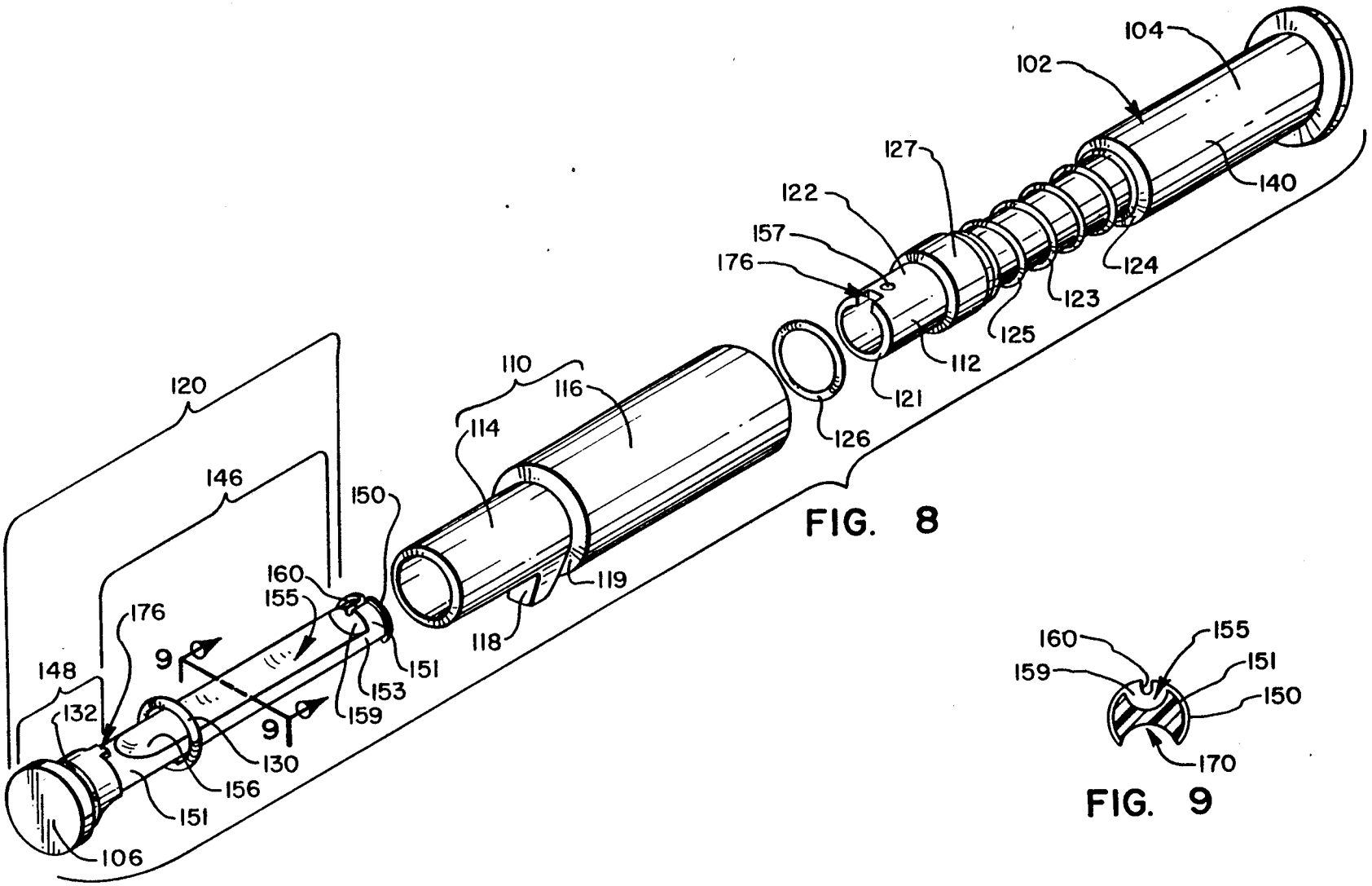
FIG. 8 is an exploded perspective view of the components of the pour spout of FIGS. 6 and 7.
FIG. 9 is a cross-sectional view of the end cap of the pour spout of FIG. 8 taken along section line 9—9 therein.

The internal elements of pour spout 100 will be better appreciated by reference to FIGS. 8 and 9 which illustrate those elements in exploded disassembly. In conjunction therewith, reference will be made as required to the cross-sectional views of structures shown in FIGS. 6 and 7 which appear in FIGS. 10 and 11, respectively.

The structures of slide valve 108 of the present invention will be investigated initially. These include a spring 123 which encircles fluid conduit 102 inside of skirt portion 116 of sleeve 110. Spring 123 is held in compression between sleeve 110 and a spring-retaining collar 124 longitudinally fixed to exterior surface 112 of fluid conduit 102. End 125 of spring 123 is disposed remote from container 12.

Slide valve 108 further includes a resilient, sleeve overflow seal 126 which slidably encircles exterior surface 112 of fluid conduit 102 on the side of the fluid discharge opening adjacent the container of fluid. Sleeve overflow seal 126 is designed to slide along fluid conduit 102 with sleeve 110. In addition, in a sleeve overflow seal protection washer 127 encircles fluid conduit 102 on the side of sleeve overflow seal 126 opposite from the fluid discharge opening.

As is more fully appreciated by reference to the cross-sectional views contained in FIGS. 10 and 11, end 125 of spring 123 bears against sleeve overflow seal protection washer 127, which in turn bears against sleeve overflow seal 126. In this manner, sleeve overflow seal 126 is urged into sealing engagement with inner surface 128 of sleeve 110 at juncture 119 thereof. As will be disclosed in additional detail subsequently, these structures combine to function as an inversion protection means for precluding overflow of fluid from the end of sleeve 110 adjacent container 12 when sleeve 110 is in the closed position of slide valve 108 and container 12 with pour spout 100 attached thereto is inverted into the position shown in FIG. 10.

According to another aspect of the present invention, the closure means thereof further comprises a valve seat on fluid conduit 102 on the side of the fluid discharge opening thereof remote from container 12. As shown by way of example fluid conduit 102 in a recessed groove 132 encircling fluid conduit 102 near the tip of remote end 106 thereof. Slide valve seal 130 may comprise a lathe-cut seal, a square-ring seal, or even an O-ring seal made of a material that resists degradation from the type of fluid contemplated for use with pour spout 100 and container 12.

In the closed position of slide valve 108 illustrated in the detailed blowup of FIG. 10A, the inner surface 134 at free end 121 of tubular portion 114 of sleeve 110 is urged by spring 123 into sealing engagement with slide valve seal 130. To improve the seal produced, the sealing portion 136 of inner surface 134, which engages resilient slide valve seal 130, may be provided with a slight outward taper as shown.

Fluid conduit 102 may be fabricated as a unitary structure. A shown in FIG. 10, however, fluid conduit 102 advantageously comprises an open-ended tube 122 having a first end 140 opening into container 12 and a second or free end 121 terminating within sleeve 110. Attached to and at least partially closing second end 121 of tube 122 is a fluid conduit end cap 120 which is preferably formed from a plastic material by a precision injection-molding technique. As best understood from FIG. 8, end cap 120 comprises an elongated first portion 146 which is inserted into second or free end 121 of tube 122 and a second portion 148 which remains exterior thereto.

End cap 120 is retained in tube 122 by a cooperating retention means for snappingly retaining first portion 146 of end cap 120 in second or free end 121 of tube 122. As best understood by reference to FIGS. 8 and 9; a retention lip 150 extends radially from the outer surface 151 of the end 153 of first portion 146 of end cap 120 adjacent container 12. Correspondingly, as seen in FIGS. 10 and 11, a retention shoulder 152 is formed on the interior of tube 122. Retention lip 150 resiliently engages retention shoulder 152 when first portion 146 of end cap 120 is fully inserted into second end 121 of tube 122. This relationship is shown to advantage in the detail view of FIG. 11A.

Naturally, a structure such as retention lip 150 need not be located at end 153 of first portion 146, but may be positioned at such a location on first portion 146 as to cooperatively engage a structure such as retention shoulder 152 on the interior of tube 122. In addition, retention lip 150 need not fully encircle first portion 146 of end cap 120, but may be a circumferentially abbreviated projection, such as a tab or post. Alternatively, however, end cap 144 can be secured in tube 122 by other means, including diverse forms of bonding.

In accordance with another aspect of the present invention, venting means are provided for admitting air into the interior space within fluid conduit 102 and container 12 during transfers of fluid from container 12, thus enabling an even-flowing transfer of fluid out of container 12. The admission of air begins, however, only after an initial transfer of fluid through the discharge opening of pour spout 100 has taken place without air being admitted into the interior space. This reduces the pressure of air in container 12 below atmospheric pressure.

Thus, back pressure is initially developed in container 12 while some fluid is transferred therefrom. As that back pressure increases to the point that continued fluid transfer would cease or involve surges and gulps, the venting means of the present invention commences to admit air into container 12. This enables an even outflow of fluid to continue. This situation persists either until fluid conduit 102 is removed from the receiving vessel, closing slide valve 108, or until fluid in the receiving vessel rises to a level that blocks the entry of air into the venting means. Thereupon, air flow into the interior space through the venting means of the present invention is terminated and fluid outflow from container 12 is promptly curtailed.

The abrupt stoppage of fluid outflow is essential if overflow of the receiving vessel is to be avoided. This object is attained through the cooperative action of airflow termination through the venting means and the existence of back pressure in container 12 throughout the entire pouring process. Were the back pressure to begin to be developed only at the time that the receiving vessel was approaching fullness, overflow protection would be uncertain. Before the cessation of fluid transfer could be achieved, the requisite back pressure would have to be developed inside container 12. For this to occur, an additional quantity of fluid would necessarily be transferred from fluid conduit 102. This additional quantity of fluid could cause the receiving container to overflow.

The venting means of the present invention as embodied in pour spout 100 comprises an air vent passageway communicating between the interior space and the exterior of fluid conduit 102 at a location which is inside the receiving vessel when the closure means described above ceases to preclude transfer of fluid from fluid conduit 102. This is the situation illustrated in FIG. 11, where the capture of projection 118 on lip 66 of receiving vessel 68 and the subsequent advancement of container 12 theretoward has moved slide valve 108 out of the closed position thereon, revealing second or free end 121 of tube 122 and end cap 120 secured therein. Discharge opening 154, which is visible in FIG. 11, is then free of obstruction, and fluid 60 begins to be transferred from container 12. The structure of discharge opening 154 will be investigated in some detail below after a disclosure of the structure of the embodiment of the venting means utilized with pour spout 100.

For this latter purpose, reference should first be made to FIG. 8, showing end cap 120 with first portion 146 thereof removed from second or free end 121 of tube 122. An elongated air vent recess 155 oriented parallel to the longitudinal axis of fluid conduit 102 is formed in outer surface 151 of first portion 146 of end cap 120. Air vent recess 155 extends neither to second portion 148 of end cap 120, nor to end 153 of first portion 146 intended to be adjacent to container 12. Instead, the end 156 of air vent recess 155 remote from container 12 terminates at a location within tube 122 that is inside a receiving vessel when the closure means described above ceases to preclude transfer of fluid from discharge opening 154.

At such a location, an outer air vent aperture 157 is formed through tube 122 so as to communicate with end 156 of air vent recess 155. Outer air vent aperture 157 is formed through fluid conduit 102 at a location which is on the opposite side of fluid conduit 102 from discharge opening 154 and which is disposed longitudinally along fluid discharge conduit at a distance D (shown in FIG. 11) toward container 12 from discharge opening 154. Advantageously, the cross-sectional area of air vent recess 155 is greater than that of outer air vent aperture 157. In this manner outer air vent aperture 157 can function as a capillary section, such as capillary section 58 of pour spout 10 shown in FIG. 2.

The cross-sectional area of air vent recess 155 may, for example, be greater than or equal to 1.5 times the cross-sectional area of outer air vent aperture 157. More preferably, the cross-sectional area of air vent recess 155 is two times that of outer air vent aperture 157.

As seen to best advantage in FIGS. 8 and 9, at end 158 of air vent recess 155 and adjacent container 12, air vent recess 155 terminates in a wall 159, the top of which comprises a portion of outer surface 151 of first portion 146 of end cap 120. Through wall 159 and in outer surface 151 is formed groove or inner air vent aperture 160 which communicates between end 158 of air vent recess 155 and the interior space within fluid conduit 102 and container 12. As best illustrated in FIGS. 10 and 11, inner air vent aperture 160 can be seen to be defined by the groove formed through wall 159 and by the inner surface 162 of tube 122 when first portion 146 of end cap 120 is inserted into second end 121 of tube 122. Inner air vent aperture 160 has a cross-sectional area which is less than the cross-sectional area of air vent recess 155. In this manner inner air vent aperture 160 can function as a capillary section, such as capillary section 58 of pour spout 10 shown in FIG. 2.

Thus, the cross-sectional area of air vent recess 155 may be greater than or equal to two times that of air vent aperture 160, or more preferably, three times the cross-sectional area of air vent aperture 160.

When first portion 146 of end cap 120 is inserted into second or free end 121 of tube 122, air vent recess 155 in combination with inner surface 162 of tube 122 defines an air vent passageway that communicates between the interior space within container 12 and pour spout 100 and the exterior of fluid conduit 102 at a location that is inside a receiving vessel when the closure means described above ceases to preclude the transfer of fluid from fluid conduit 102. Located in the air vent passageway are a pair of capillary sections having cross-sectional areas less than that of the air vent passageway itself. The capillary sections take the form of outer air vent aperture 157 and inner air vent aperture 166.

For a better understanding of the operation of the venting means of the present invention, reference should be made to FIG. 10 showing slide valve 108 in the closed position thereof in combination with FIG. 11 showing the same structure, but with slide valve 108 out of the closed position thereof.

As seen in the latter of these figures, outer air vent aperture 157 is formed through second or free end 121 of tube 122 at a location which is inside receiving vessel 68 when slide valve 108 ceases to preclude transfer of fluid therefrom. The mechanism of fluid transfer will be investigated in detail subsequently. The air vent passageway defined by air vent recess 155 and inner surface 162 of tube 122 communicates at end 156 with the exterior of tube 122 through outer air vent aperture 157. Outer air vent aperture 157 has a cross-sectional area that is less than that of the air vent passageway, thus functioning as a first capillary section interposed in the air vent passageway.

End 156 of air vent recess 155 in turn communicates with the interior space inside fluid conduit 102 and container 12 through a second capillary section taking the form of inner air vent aperture 160 defined by the groove in outer surface 151 at the top of wall 159 and the inner surface 162 of tube 122. Alternatively, a structure equivalent to air vent recess 155 could take the form of an aperture formed through wall 159.

End cap 120 may be made of injection molded plastic in a known manner, while outer air vent aperture 157 can be formed through tube 122 in any known conventional manner. By the air vent passageway and associated capillary sections which result from the cooperating structure formed by the insertion of first portion 146 of end cap 120 into second or free end 121 of tube 122 can thus be precisely controlled in size without recourse to complicated machining. In addition, only two components are involved, resulting in a pour spout ventilation system which is extremely simple and efficient to manufacture. Inner air vent aperture 160, and outer air vent aperture 157 to a more limited extent, together function as a constriction means for retarding the entry of fluid into the disclosed air vent passageway when fluid is being transferred from container 12 to a receiving vessel.

The manner in which this phenomena occurs and the advantages thereof are similar to those disclosed in relation to the retention of air column 56 in air vent tube 52 in FIGS. 3A, 3B, and 3C above.

As also discussed earlier, in relation to FIG. 3A, when container 12 with pour spout 100 attached thereto is inverted preparatory to pouring, fluid therefrom enters interstitial space 166 between sleeve 110 and fluid conduit 102. As the fluid in interstitial space 166 increases, the level thereof will rise until the fluid reaches the end of sleeve 110 adjacent container 12. This offers the undesirable potential for overflowing of fluid from skirt portion 116 of sleeve 110 when container 12 is inverted for any substantial amount of time. Accordingly, the pour spout of the present invention further comprises inversion protection means for precluding overflow of fluid accumulating in interstitial space 166 from the end of sleeve 110 adjacent container 12.

As shown, for example, in FIG. 10, one embodiment of such an inversion protection means takes the form of sleeve overflow seal 126 which is urged into sealing engagement with inner surface 128 of sleeve 110 at juncture 119 by the action of compressed spring 123 in urging sleeve overflow seal protection washer 127 against sleeve overflow seal 126. These structures prevent fluid in interstitial space 166 from even entering the interior of skirt portion 116.

FIGS. 10 and 11 lend a fuller appreciation of the structure and functioning of discharge opening 154. Discharge opening 154 communicates with the interior of fluid conduit 102 through a discharge passageway formed in end cap 120 as an elongated fluid 170 recess oriented parallel to the longitudinal axis of fluid conduit 102. Fluid recess 170 traverses the full length of first portion 146 of end cap 120 and a section of second portion 148 contiguous therewith. That part of fluid recess 170 formed in second portion 148 of end cap 144 terminates in discharge opening 154.

Advantageously, at the end of fluid recess 170 remote from container 12 the wall 172 of discharge passageway closest to the center of fluid conduit 102 turns outwardly from the center of end cap 120 and intersects the exterior thereof to form the edge 174 of discharge opening 154 remote from container 12. In this manner, fluid transferred through fluid recess 170 and discharge opening 154 is imparted a substantial component of momentum away from container 12 and parallel to the longitudinal axis of fluid conduit 102. This eliminates splashing of the fluid from the receiving vessel 68 by insuring that fluid being transferred from container 12 does not impact the walls or lip 66 of the receiving vessel 68 in a direction normal thereto.

End cap 120 is inserted into second or free end of tube 122 and snapped into place by the action of retention lip 150 and retention shoulder 152. To assist in the correct rotational placement of end cap 20 in second or free end 121 of tube 122, a slot-and-key system 176 shown by way of example in FIG. 7 may be adopted. In this manner, the assembly of end cap 120 into second or free end 121 of tube 122 will be insured to place air vent recess 155 in communication with outer air vent aperture 157.

Typical sizes for elements of a pour spout 100 having an inside diameter of 0.50 inches include a fluid recess 170 having a cross-sectional area of 0.30 square inches in combination with an air vent recess having a cross-sectional area of 0.15 square inches. In such a structure, inner air vent aperture 160 would have a cross-sectional area of approximately 0.050 square inches, while outer air vent aperture would have a cross-sectional area of approximately 0.07 square inches. Advantageously, the longitudinal distance D shown in FIG. 11 between outer air vent aperture 157 and discharge opening 154 should be at least 0.25 inches. A pour spout 100 having elements thereof provided with such dimensions will produce acceptable functioning when used with a container for gasoline having a volume in the range of from approximately 1.0 gallons to approximately 2.5 gallons.

It will prove instructive as to operation of the inventive pour spout to discuss briefly the effect on pour spout functioning caused by variations in selected physical parameters thereof.

For example, it is possible to form an outer air vent aperture in the manner in which discharge opening 154 is produced. This would involve extending end 156 of air vent recess 155 longitudinally away from container 12 to a point beyond second or free end 121 of tube 122, thereby to form an outer air vent aperture in second portion 148 of end cap 120. No aperture would then need to be formed through the wall of tube 122 in order that air vent recess 155 to communicate with the exterior of pour spout 100. Outer air vent aperture 157 would instead be located in second portion 148 of end cap 120 on the side of discharge opening 154 opposite from container 12.

Under such circumstances, the longitudinal distance D shown in FIG. 11 between outer air vent aperture 157 and discharge opening 154 would become extremely small, approaching zero as the position of outer air vent aperture 157 approaches a position on pour spout 100 laterally opposite from discharge opening 154. So long as pour spout 100 is oriented at an angle to the vertical as shown in FIG. 11, the reduction of the longitudinal distance D to a zero value will not, however, place air vent aperture 157 and discharge opening 154 at the same vertical level. Instead, a vertical height differential V will exist therebetween insuring desired pour spout functioning. Only when spout 100 is oriented in a vertical position, and when longitudinal distance D assumes a zero value, will the vertical height differential V also equal zero. Such an alternative location of an outer air vent aperture produces less satisfactory functioning in pour spout 100 than the arrangement illustrated in FIGS. 10 and 11.

The displacement of outer air vent aperture 157 the longitudinal distance D toward container 12 from discharge opening 154 preserves a non-zero vertical height differential V and insures that the entry of air bubbles 70 into container 12 begins at a stage in pouring that precedes the commencement of gulping flow of fluid 60 from discharge opening 154. The entry of air bubbles 70 commences when the back pressure developed above fluid 60 in container 12 becomes equal to the head pressure produced in fluid 12 at outer air vent aperture 157. Gulping flow occurs if the back pressure developed in container 12 unrelieved by the operation of any venting means becomes substantial enough to equal the head pressure in fluid 60 at discharge opening 154. Then air is drawn into container 12 through fluid recess 170 instead of through air vent recess 155.

From a different perspective, the displacing of outer air vent aperture 157 a longitudinal distance D from discharge opening 154 toward container 12 and the non-zero vertical height differential V that results reflects that air vent aperture 157 is closer vertically to the surface of fluid 60 in container 12 than is discharge opening 154. Accordingly, the head pressure in fluid 60 at air vent aperture 157 is less than that at discharge opening 154. As the back pressure in container 12 increases during the unvented outflow of fluid 60, the back pressure will thus reach a value equal to the value of the head pressure in fluid 60 at air vent aperture 157 before it reaches a value equal to the head pressure in fluid 160 at discharge opening 154.

The entry of air bubbles 70 through the venting means of the inventive pour spout will corresponding commence before the back pressure in container 12 becomes substantial enough to induce gulping fluid flow from discharge opening 154. The commencement of vented fluid flow in which air bubbles 70 enter the interior of container 12, will under most conditions prevent any further increase in the back pressure above fluid 60 in container 12. As a result the back pressure in container 12 never reaches a value sufficient to overcome the head pressure in fluid 60 at discharge opening 154, and no gulping fluid flow occurs during the entire pouring process.

The larger the longitudinal distance D of outer air vent aperture 157 from discharge opening 154, the earlier in the pouring process will the entry of air bubbles 70 commence. Conversely, the smaller the longitudinal distance D of outer air vent aperture 157 from discharge opening 154, the later the pouring process will the entry of air bubbles 70 commence. Stated in other terms, as the position of outer air vent aperture 157 in fluid conduit 102 is moved further from container 12, the greater will be the amount of back pressure required in container 12 before the commencement of vented fluid flow in which air bubbles 70 enter the interior of container 12.

The positioning of outer air vent aperture 157 further from container 12 has other consequences. It places outer air vent aperture 157 deeper inside receiving vessel 68. Air vent aperture 157 is thus blocked by the rise of fluid in receiving vessel 68 at a stage in pouring in which the fluid in receiving vessel 68 is further from lip 66 and thus less likely to overflow therefrom. Nevertheless, when outer air vent aperture 157 is located proximate longitudinally to discharge opening 154, there is an increased likelihood that the greater back pressure that develops in container 12 during unvented fluid outflow through pour spout 100 will produce gulping flow of fluid 60 through discharge opening 154, rather than causing vented flow by the entry of air bubbles 70 into container 12.

When container 12 is inverted into the position shown in FIG. 10 with slide valve 108 in the closed position thereof, fluid 60 flows through discharge opening 154 into interstitial space 166 and then into outer air vent aperture 157 from the exterior of tube 122. This forces air out of air vent recess 155 through inner air vent aperture 160 as air bubbles 70, gradually eliminating any air column in air vent recess 155. In the process, some fluid 60 will also enter air vent recess 155 through inner air vent aperture 160, exchanging itself for air therein and trickling down the walls of air vent recess 155. Eventually, if slide valve 108 is not opened promptly, air vent recess 155 becomes completely full of fluid 60.

Thereafter, when slide valve 108 is opened, fluid will commence to flow out of container 12 both through discharge opening 154 and to a lesser extent through outer air vent aperture 157. Gradually, the back pressure above fluid 60 in container 12 will increase until the point that the back pressure is equal to the head pressure at outer air vent aperture 157. Air is then drawn into container 12 through outer air vent aperture 157.

The flow of air bubbles 70 through the venting means of the inventive pour spout reestablishes the air column 65 in air vent recess 155. As discussed in relation to FIG. 3A, air column 65 is usually required to insure a continuous smooth vented discharge of fluid 60 through opening 154. To function in the manner required, air column 65 in air vent recess 155 should remain isolated from the atmospheric pressure exterior to pour spout 100. This is accomplished in pour spout 100 utilizing fluid 60 itself.

Even after air vent recess 155 has been substantially emptied of fluid 60 by the ingress of air through outer air vent aperture 157, a quantity of fluid **60*a* shown in FIG. 11, remains suspended at end 156 of air vent recess 155 blocking outer air vent aperture 157. Entering air merely bubbles through this quantity of fluid 60*a* into air column 65 causing air bubbles 70 to emerge into container 12 through inner air vent aperture 160. The quantity of fluid 60*a* accordingly functions as a one-way valve at the external entry to air vent recess 155**.

If the cross section of outer air vent aperture 157 is relatively large, no fluid for this one-way valving function will be retained after slide valve 110 has been opened. Under such circumstances, air column 65 is no longer isolated from ambient air pressure, and the air pressure at end 158 of air vent recess 155 becomes equal to ambient air pressure. Such a result will cause a termination in the entry of air bubbles 70, if inner air vent aperture 160 is not located in fluid conduit 102 at a position higher relative to the surface of fluid 60 in container 12 than the location of the entry 182 to fluid recess 170 at the end thereof adjacent container 12.

As illustrated in FIG. 11, both inner air vent aperture 160 and entry 182 to fluid recess 170 are substantially the same longitudinal distance along pour spout 100 from container 12. Nevertheless, as seen in FIG. 11A air vent recess 155 is located on the opposite side of pour spout 100 from both fluid recess 170 and projection 118 of sleeve 110. By this arrangement a height difference H exists relative to the surface of fluid 60 in container 12 between inner air vent aperture 160 and entry 182 into fluid recess 170.

If container 12 is tilted further upward from the position illustrated in FIG. 11, height difference H will approach a zero value. When the height difference H of inner air vent aperture 160 above entry 182 approaches zero, the cross section of outer air vent aperture 157 must be small enough that the quantity of fluid **60*a* is retained therein to isolate air column 65 in air vent recess 155 from the outer atmosphere. This requirement imposed on the size of outer air vent aperture 157 can be alleviated by extending inner air vent aperture 160 upwardly toward container 12 without similarly displacing entry 182 into fluid recess 170 toward container 12**.

The cross section of outer air vent aperture 157 cannot, however, be reduced without limit. Where the cross section of outer air vent aperture 157 is very small, air bubbles 70 attempting to enter container 12 through the venting means of the inventive pour spout will not be able to do so fast enough to replace in volume the fluid 60 flowing out of container 12 by way of discharge opening 154. The back pressure in container 12 will then increase, and gulping flow of fluid 60 through discharge opening 154 will be ongoing. Inner air vent aperture 160 is also subject to such a sizing constraint.

With container 12 inverted as in FIG. 10 and with slide valve 108 in the closed position thereof, fluid 60 gives rise to head pressure which is maximized at the lowest point in pour spout 100. Preferably, this is at discharge opening 154. The head pressure caused by fluid 60 decreases upwardly therefrom through fluid 60 to the surface thereof in container 12. When slide valve 108 is drawn out of the closed position thereof shown in FIG. 10 into the open position illustrated in FIG. 11, fluid 60 flows out of container 12 through pour spout 100, and this is no longer the case.

First, a period ensues in which fluid 60 flows out of container 12 while no air is admitted thereinto. This causes a back pressure to be developed in container 12 above the surface of fluid 60. This back pressure increases directly relative to the total volume of fluid 60 that has flowed out of container 12 through pour spout 100. In the process, the fluid head pressure within fluid 60 itself is progressively offset by the effect of the back pressure created thereabove in container 12. Eventually, the back pressure becomes sufficiently strong to offset the head pressure of fluid 60 at outer air vent aperture 157, whereupon the venting of air therethrough into container 12 commences.

As discussed above, this ingress of air through outer air recess 157 reestablishes air column 65 in air vent recess 155 and a dynamic state results in which fluid 60 flows out of discharge opening 154 and a corresponding volume of air enters container 12 through air vent recess 155. In this dynamic state of vented fluid flow, the highest head pressure produced by fluid 60 is located up stream from discharge opening 154 in fluid recess 170, possibly as high in pour spout 100 as entry 182 into fluid recess 170.

In the dynamic state of vented fluid flow the point of highest head pressure produced in fluid 60 defines the location of what will be referred to hereinafter as an "effective fluid outlet". Downstream of this effective fluid outlet fluid 60 flows freely in fluid recess 170 and out of fluid discharge opening 154. In dynamic vented fluid flow, the effective fluid outlet will be located upstream from discharge opening 154 in fluid recess 170, possibly as high in pour spout 100 as entry 182 into fluid recess 170. Nevertheless, the precise position of the effective fluid outlet during dynamic flow will vary according to a number of factors, a few of which will be discussed subsequently.

It is worth noting that during the dynamic state of vented outflow of fluid 60, the amount of back pressure developed above fluid 60 in container 12 will remain in a range that is greater than the amount of head pressure produced in fluid 60 at inner air vent aperture 160, but less than the amount of maximum head pressure produced in fluid 60 at the effective fluid outlet. Whenever the back pressure deviates from this range, uniform vented outflow of fluid 60 is impaired.

When the back pressure above fluid 60 in container 12 becomes less than the amount of head pressure produced in fluid 60 at inner air vent aperture 160, the inflow of air bubbles 70 ceases. The outflow of fluid 60 is then slowed, and the operation of the pour spout reverts temporarily to one of fluid outflow without any air venting. Eventually, through the outflow of fluid 60 under these conditions the amount of back pressure above fluid 60 in container 12 will again increase to the point that it is equal to or greater than the head pressure produced in fluid 60 at inner air vent aperture 160. Then desireable vented fluid outflow will resume.

The result is a first type of operational cycling between vented and unvented fluid outflow. While a pour spout, such as pour spout 100, producing such a first type of operational cycling is still considered to be within the scope of the present invention, cycling represents a less than optimum arrangement of the size of the components of pour spout 100 for the type of container 12 and fluid 60 to be dispensed.

On the other hand, when the back pressure above fluid 60 in container 12 exceeds the maximum of head pressure produced in fluid 60 at the effective fluid outlet, air will be drawn up fluid recess 170 producing gulping flow. The air drawn up fluid recess 170 will relieve the excessive back pressure above fluid 60 and permit the system to temporarily resume the desired vented fluid outflow. The result is a second type of operational cycling between vented and gulping fluid outflow.

While a pour spout, such as pour spout 100, producing such a second type of operational cycling is still considered to be within the scope of the present invention, cycling represents a less than optimum arrangement of the size of the components of pour spout 100 for the type of container 12 and fluid 60 to be dispensed.

The size of the cross section of fluid recess 170 also affects the functioning of pour spout 100. If the cross section of fluid recess 170 is overly large relative to the cross section of the smaller of outer air vent aperture 157 and inner air vent aperture 160, then fluid 60 will flow through fluid recess 170 at a volumetric rate in excess of the rate at which air can be vented through air vent recess 155 into container 12. Whenever this occurs, the back pressure above fluid 60 in container 12 will increase to an extent that it is capable of overcoming even the maximum head pressure in fluid 60 at the effective fluid outlet in fluid recess 170. Then, air will be drawn up fluid recess 170, producing gulping flow. This will recur on a periodic basis, whereby undesirable splashing of fluid 60 into receiving container 68 will be produced.

It is preferable that the cross section of fluid recess 170 be constant along the length thereof. Any reduction in the cross section of fluid recess 170 will tend to define thereat the effective fluid outlet, drawing to that reduction the point of maximum head pressure produced in fluid 60 during the dynamic state of vented fluid flow. Where a reduction of the cross section of fluid recess 170 is close to discharge opening 154, a slow outflow of fluid 60 will result. In compensation, however, the cessation of the outflow of fluid 60 will be abrupt whenever outer air vent recess 157 becomes blocked by fluid 60 filling receiving container 68.

Any combination of the physical parameters just discussed may be appropriate in any given situation. Such variations in the relative sizes and positions of structural elements of pour spout 100 are considered to be within the scope of the present invention.

Pour spout performance is influenced in addition by the volume and tallness of container 12, the relative fullness of container 12, the viscosity and density of the fluid therein, and the diameter and length of fluid conduit 102.

Figure 12:
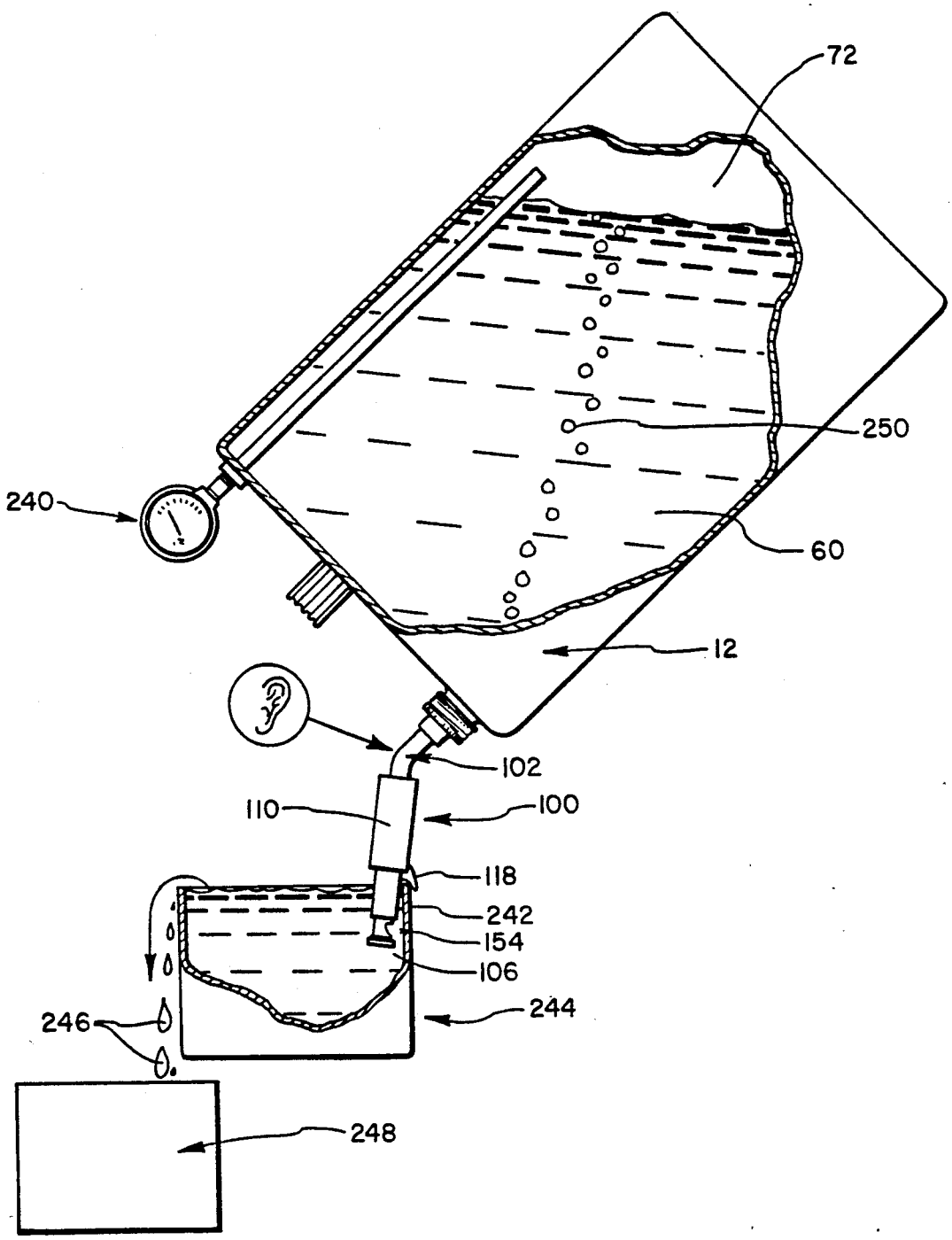
FIG. 12 is a diagram schematically illustrating one arrangement of equipment for investigating the operation of a pour spout embodying the teachings of the present invention.

FIG. 12 illustrates one arrangement of equipment which has been used to verify the manner in which the inventive pour spout functions to effect the surprisingly prompt termination of fluid transfer observed therewith. A container 12 of fluid 60 is fitted with an inventive pour spout, such as pour spout 100 discussed in relation to FIGS. 6–11. A pressure gauge 240 is attached to container 12 in such a manner as to be capable of measuring the back pressure developed in space 72 above fluid 60.

Container 12 is inverted and projection 118 on sleeve 110 is made to catch lip 242 of a receiving vessel 244. Thereafter, as fluid conduit 102 is advanced into receiving container 244, remote end 106 of fluid conduit 102 emerges from sleeve 110 and fluid begins to be transferred through discharge openings 154. If receiving container 244 is full at the onset of transfer, then the over flow 246 therefrom, which can be caught in a secondary receiving container 248, is an accurate measure of the amount of fluid that has been transferred. Auditory monitoring of fluid conduit 102 discloses the point in time at which bubbles 250 of air begin to be admitted through the venting means of pour spout 100 into the interior space within fluid conduit 102 and container 12.

Using the arrangement of equipment shown in FIG. 12, it has been verified that back pressure in the space 72 above fluid 60 is initially developed in an amount approximately equal to the fluid head pressure between the top surface of fluid 60 and discharge opening 154. This corresponds to the amount of back pressure required to substantially curtail continued transfer of fluid through discharge opening 154 after which, without venting of container 12, the undesirable surges and gulping described earlier in the specification will occur. For a fluid conduit 102 comprising a tube 138 having an outer diameter of 0.875 inches and a wall thickness of 0.035 inches, the amount of fluid transferred from discharge opening 154 before bubbles 250 of air begin to be admitted into container 12 is shown below.

TABLE

| Nominal Size of Container 12 (gallons) | Quantity of Fluid in Container 12 at Outset (gallons) | Volume of Fluid Transferred Prior to Admission of Bubbles 250 of Air(oz) |
|---|---|---|
| 1.00 | 1.00 | 3.0 |
| | 0.50 | 3.3 |
| 2.50 | 2.50 | 3.0 |
| | 1.50 | 5.0 |
| | 0.50 | 5.5 |
| 5.00 | 5.00 | 4.0 |
| | 4.00 | 7.0 |
| | 3.00 | 9.0 |
| | 2.00 | 11.0 |
| | 1.00 | 12.0 |

The above experiments which were uniformly conducted using gasoline, illustrate that a number of variables including fluid depth, and container space unfilled by fluid effect the quantity of fluid transfer required to initiate venting by air 250. The density of the fluid being transferred can also be reasonably expected to impact the timing of the initiation of air admission, although this parameter was not directly tested.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A pour spout for permitting transfer of a fluid from a container of the fluid to a receiving vessel, the pour spout comprising:

(a) a fluid conduit opening at one end thereof into the container of fluid, said fluid conduit being provided at a location remote from the container with a fluid discharge opening through which fluid from the container is transferred into the receiving vessel;

(b) closure means for precluding any transfer of the fluid through said discharge opening into the receiving vessel until said fluid discharge opening is inside the receiving vessel; and (c) venting means for admitting air into the interior space within said fluid conduit and the container during transfer of the fluid from the container, air flow into said interior space through said venting means becoming terminated when the receiving vessel becomes filled with the fluid, said venting means comprising:

(i) an air vent passageway communicating between said interior space and the exterior of said fluid conduit at a location that is inside the receiving vessel when said closure means ceases to preclude the transfer of fluid from said fluid conduit; and (ii) a capillary section located in said air vent passageway, said capillary section having a cross-sectional area less than that of said air vent passageway.

2. A pour spout as recited in claim 1, wherein said closure means comprises:

(a) a slide valve having a closed position in which transfer of the fluid through said discharge opening is precluded;

(b) a spring urging said slide valve into said closed position thereof; and (c) slide valve release means for co-acting with the receiving vessel to move said slide valve out of said closed position thereof when said fluid discharge opening on said fluid conduit enters into the receiving vessel.

3. A pour spout as recited in claim 2, wherein said slide valve comprises:

(a) a sleeve closely conforming to the exterior surface of said fluid conduit and mounted for sliding motion thereupon; and (b) a valve seat on said fluid conduit on the side of said fluid discharge opening remote from the container of fluid, said sleeve being urged by said bias means into sealing engagement with said valve seal in said closed position of said slide valve.

4. A pour spout as recited in claim 3, wherein said valve seal comprises a resilient slide valve seal encircling said fluid conduit on the side of said fluid discharge opening remote from the container of fluid, said slide valve seal being engaged by the end of said sleeve remote from the container when said sleeve is in said closed position of said slide valve.

5. A pour spout as recited in claim 4, wherein said slide valve seal is a lathe-cut seal.

6. A pour spout as recited in claim 4, wherein said slide valve seal is a square-ring seal.

7. A pour spout as recited in claim 4, wherein said slide valve seal is an O-ring.

8. A pour spout as recited in claim 4, wherein said valve seal further comprises a groove on the exterior of said fluid conduit on the side of said fluid discharge opening remote from the container of fluid, and wherein said slide valve seal is retained in said groove.

9. A pour spout as recited in claim 3, wherein said slide valve release means comprises a projection secured to said sleeve and being so configured as to catch the receiving vessel and draw said sleeve out of said closed position of said slide valve as said discharge opening on said fluid conduit enters the receiving vessel.

10. A pour spout as recited in claim 3, wherein said spring is disposed encircling said fluid conduit and retained in compression between said sleeve and a longitudinally fixed point on said fluid conduit, thereby urging said sleeve along said fluid conduit in a direction away from the container.

11. A pour spout as recited in claim 10, wherein said spring is disposed encircling said fluid conduit inside said sleeve.

12. A pour spout as recited in claim 3, wherein said slide valve further comprises inversion protection means for precluding overflow of fluid from the end of said sleeve adjacent the container of fluid when said sleeve is in said closed position of said slide valve.

13. A slide valve as recited in claim 12, wherein said inversion protection means comprises a resilient sleeve overflow seal slidably encircling said fluid conduit on the side of said fluid discharge opening adjacent the container of fluid, said sleeve overflow seal sliding on said fluid conduit with said sleeve.

14. A slide valve as recited in claim 13, wherein said slide valve further comprises a sleeve overflow seal protection washer slidably encircling said fluid conduit on the side of said sleeve overflow seal opposite from said fluid discharge opening.

15. A slide valve as recited in claim 14, wherein said spring is disposed encircling said fluid conduit inside said sleeve, and wherein said spring is retained in compression between said sleeve overflow seal protection washer and a longitudinally fixed point on said fluid conduit, thereby to urge said sleeve overflow seal into engagement with the inner surface of said sleeve.

16. A pour spout as recited in claim 1, wherein said discharge opening communicates with the interior of said fluid conduit through a discharge passageway, and said discharge passageway and said fluid discharge opening are so configured that fluid transferred through said discharge opening is imparted a substantial component of momentum away from the container parallel to the longitudinal axis of said fluid conduit.

17. A pour spout as recited in claim 16, wherein a first end of said discharge passageway communicates with said interior of said fluid conduit and is disposed parallel to the longitudinal axis thereof, and wherein the second end of said discharge passageway turns radially outwardly from the center of said fluid conduit and intersects the exterior of said fluid conduit to form said discharge opening.

18. A pour spout as recited in claim 1, wherein said fluid conduit comprises:

(a) a tube having first and second open ends, said first end of said tube opening into the container of fluid; and (b) a fluid conduit end cap attached to and at least partially closing said second end of said tube, said end cap having formed therein said fluid discharge opening and a discharge passageway communicating from said discharge opening to the interior of said tube.

19. A pour spout as recited in claim 18, wherein the surface of said end cap on the side of said fluid discharge opening remote from the container of fluid is encircled by a continuous groove in which to retain a resilient seal.

20. A pour spout as recited in claim 1, wherein said capillary section comprises an outer air vent aperture formed through said fluid conduit at a location that is inside the receiving vessel when said closure means ceases to preclude transfer of fluid from said fluid conduit.

21. A pour spout as recited in claim 20, wherein said outer air vent aperture is formed through said fluid conduit at a location which is on a side of said fluid conduit opposite from said discharge opening.

22. A pour spout as recited in claim 20, wherein said outer air vent aperture is formed through said fluid conduit at a location which is disposed longitudinally along said fluid discharge conduit from said discharge opening toward the container of fluid.

23. A pour spout as recited in claim 1, wherein said fluid conduit comprises:

(a) a tube having first and second open ends, said first end of said tube opening into the container of fluid; and (b) a fluid conduit end cap attached to said second end of said tube, said end cap having formed therein at least a portion of said air vent passageway.

24. A pour spout as recited in claim 1, wherein said fluid conduit comprises:

(a) a tube having first and second open ends, said first end of said tube opening into the container of fluid; and (b) a fluid conduit end cap attached to and at least partially closing said second end of said tube, said end cap comprising:

(i) an elongated first portion which is inserted into said second end of said tube with the outer surface of said first portion engaging the inner surface of said second end of said tube; and (ii) a second portion disposed exterior to said second end of said tube when said first portion of said end cap is inserted thereinto.

25. A pour spout for permitting transfers of a fluid from a container of the fluid to a receiving vessel, the pour spout comprising:

(a) a fluid conduit opening at one end thereof into the container of fluid, said fluid conduit being provided at a location remote from the container with a fluid discharge opening through which fluid from the container is transferred into the receiving vessel, said fluid conduit comprising:

(i) a tube having first and second open ends, said first end of said tube opening into the container of fluid; and (ii) a fluid conduit end cap attached to and at least partially closing said second end of said tube, said end cap having formed therein said fluid discharge opening;

(b) a slide valve having a closed position in which transfer of the fluid through said discharge opening is precluded;

(c) bias means for urging said slide valve into said closed position thereof;

(d) slide valve release means for co-acting with the receiving vessel to move said slide valve out of said closed position thereof when said fluid discharge opening enters the receiving vessel; and (e) venting means for admitting air into the interior space within said fluid conduit and container during transfer of the fluid from the container, air flow into said interior space through said venting means becoming terminated when the receiving vessel becomes filled with the fluid, said venting means comprising:

(i) an air vent passageway communicating between said interior space and the exterior of said fluid conduit at a location that is inside the receiving vessel when said slide valve is out of said closed position thereof; and (ii) air vent passageway constriction means for retarding the entry of fluid into said air vent passageway when fluid is being transferred from the container to the receiving vessel, thereby retaining a column of air in said air vent passageway during transfer of the fluid.

26. A pour spout as recited in claim 25, wherein said venting means further comprises an outer air vent aperture formed through said fluid conduit at a location thereon which is inside the receiving vessel when said slide valve is moved out of said closed position thereof by said slide valve release means, said outer air vent aperture being thereby obstructable by fluid to terminate air flow therethrough into said interior space when the receiving container fills with fluid.

27. A pour spout as recited in claim 26, wherein said outer air vent aperture has a cross-sectional area less than that of said air vent passageway.

28. A pour spout as recited in claim 26, wherein said air vent passageway constriction means comprises a capillary section located in said air vent passageway having a cross-sectional area less than that of said air vent passageway.

29. A pour spout as recited in claim 28, wherein said capillary section is located at the end of said air vent passageway remote from said outer air vent aperture.

30. A pour spout as recited in claim 29, wherein said cross-sectional area of said air vent passageway is greater than or equal to about two times that of said capillary section.

31. A pour spout as recited in claim 30, wherein the cross-sectional area of said air vent passageway is greater than or equal to about three times that of said capillary section.

32. A pour spout as recited in claim 26, wherein the cross-sectional area of said air vent passageway is greater than or equal to about 1.5 times that of said outer air vent aperture.

33. A pour spout as recited in claim 32, wherein the cross-sectional area of said air vent passageway is greater than or equal to about two times that of said outer air vent aperture.

34. A pour spout as recited in claim 25, wherein said air vent tube constriction means comprises two capillary sections spaced apart and located in said air vent passageway, each of said capillary sections having a cross-sectional area less than that of said air vent passageway.

35. A pour spout as recited in claim 34, wherein said two capillary sections are located at opposite ends of said air vent passageway.

36. A pour spout as recited in claim 35, wherein a first of said two capillary sections is formed through said fluid conduit at a location that is inside the receiving vessel when said slide valve is out of said closed position thereof, and wherein a second of said two capillary sections is located at the end of said air vent passageway opposite from said first capillary section.

37. A pour spout as recited in claim 26, wherein said outer air vent aperture is formed through said fluid conduit at a location which is on a side of said fluid discharge conduit opposite from said discharge opening.

38. A pour spout as recited in claim 26, wherein said outer air vent aperture is formed through said fluid conduit at a location which is disposed longitudinally along said fluid discharge conduit from said discharge opening toward the container of fluid.

39. A pour spout as recited in claim 28, wherein said end cap comprises a first portion which is inserted into said second end of said tube and a second portion which is exterior thereto, and wherein an elongated air vent recess oriented parallel to the longitudinal axis of said fluid conduit is formed in the surface of said first portion.

40. A pour spout as recited in claim 39, wherein the end of said air vent recess remote from the container of fluid extends to a location within said tube that is inside the receiving vessel when said closure means ceases to preclude transfer of fluid from said fluid conduit.

41. A pour spout as recited in claim 40, wherein said capillary section comprises an outer air vent aperture formed through said fluid conduit to communicate with said end of said air vent recess remote from the container of fluid.

42. A pour spout as recited in claim 40, wherein said capillary section comprises an inner air vent aperture communicating between the end of said air vent recess adjacent the container of fluid and the interior space within said fluid conduit and the container.

43. A pour spout as recited in claim 25, wherein said end cap comprises:

(a) an elongated first portion inserted into said second end of said tube with the outer surface of said first portion engaging the inner surface of said second end of said tube; and (b) a second portion disposed exterior to said second end of said tube when said first portion of said end cap is inserted thereinto.

44. A pour spout as recited in claim 43, wherein an elongated fluid recess oriented parallel to the longitudinal axis of said fluid conduit is formed in the outer surface of said first portion of said end cap along the full length of said first portion and along the surface of a section of said second portion continuous therewith; and wherein an air vent recess oriented parallel to the longitudinal axis of said fluid conduit is formed in the outer surface of said first portion of said end cap along a section thereof disposed radially opposite from said fluid recess.

45. A pour spout as recited in claim 44, wherein the end of said air vent recess remote from the container extends to a location that is inside the receiving vessel when said closure means ceases to preclude transfer of fluid from said fluid conduit, and wherein said capillary section comprises an outer air vent aperture formed through said fluid conduit at said end of said air vent recess remote from the container of fluid.

46. A pour spout as recited in claim 44, wherein said capillary section comprises an inner air vent aperture formed in the outer surface of said first portion of said end cap between the end of said air vent recess adjacent said container of fluid and the end of said first portion of said end cap remote from said second portion thereof.

47. A pour spout for permitting transfers of a fluid from a container of the fluid to a receiving vessel, the pour spout comprising:

(a) a fluid conduit opening at one end thereof into the container of fluid, said fluid conduit being provided at a location remote from the container with a fluid discharge opening through which fluid from the container is transferred into the receiving vessel, said fluid conduit comprising:

(i) a tube having first and second open ends, said first end of said tube opening into the container of fluid; and (ii) a fluid conduit end cap attached to and at least partially closing said second end of said tube;

(b) an outer air vent aperture formed through said fluid conduit at a location which is inside the receiving vessel when fluid is transferred therefrom into the receiving vessel;

(c) an air vent passageway communicating at a first end thereof with the interior space within said fluid conduit and the container and communicating at the second end thereof with said outer air vent aperture, said air vent passageway having a cross-sectional area greater than that of said outer air vent aperture;

(d) air vent passageway constriction means for retarding the entry of fluid into said air vent passageway when fluid is being transferred from the container to the receiving vessel, thereby to retain a column of air in said air vent tube during transfers of the fluid.

48. A pour spout as recited in 47, wherein said air vent tube constriction means comprises a capillary section located in said air vent passageway having a cross-sectional area less than that of said air vent passageway.

49. A pour spout as recited in claim 48, wherein said capillary section is located at said first end of said air vent passageway.

50. A pour spout as recited in claim 47, further comprising closure means for precluding any transfer of fluid through said discharge opening until said fluid discharge opening is inside the receiving vessel.

* * * * *

UNITED STATES PATENT AND TRADEMARK OFFICE

CERTIFICATE OF CORRECTION

PATENT NO. : 5,249,611

DATED : October 5, 1993

INVENTOR(S) : VERL LAW

It is certified that error appears in the above-indentified patent and that said Letters Patent is hereby corrected as shown below:

Column 9, line 16, "mean s" should be --means--

Column 16, line 66, after "example" insert --in FIG. 8, a resilient, slide valve seal 130 is retained on--

Column 22, line 39, after "later" insert --in--

Signed and Sealed this

First Day of November, 1994

*Attest:*

*Attesting Officer*

Bruce Lehman

BRUCE LEHMAN

*Commissioner of Patents and Trademarks*